United States Patent [19]

Fearon

[11] Patent Number: 4,539,558

[45] Date of Patent: Sep. 3, 1985

[54] ANTITHEFT SYSTEM

[75] Inventor: Edward R. Fearon, Richardson, Tex.

[73] Assignee: Shin International, Inc., Southfield, Mich.

[21] Appl. No.: 323,593

[22] Filed: Nov. 24, 1981

[51] Int. Cl.[3] ..... G08B 13/24

[52] U.S. Cl. ..... 340/572; 340/551

[58] Field of Search ..... 340/572, 551

[56] References Cited

U.S. PATENT DOCUMENTS

| | | | |
|---|---|---|---|
| 4,168,496 | 9/1979 | Lichtblau | 340/572 |
| 4,300,183 | 11/1981 | Richardson | 340/572 |
| 4,384,281 | 5/1983 | Cooper | 340/572 |

*Primary Examiner*—Glen R. Swann, III

*Attorney, Agent, or Firm*—Gifford, Van Ophem, Sheridan, Sprinkle & Nabozny

[57] ABSTRACT

The present invention provides an antitheft system comprising a pair of spaced coils which are excited to produce an alternating magnetic field within a surveillance zone between the coils. Thus, a magnetic marker having a permeability of less than 150,000 and a coercive force of substantially 2.5 MA/CM which is carried through the surveillance zone cuts or links lines of magnetic flux within the zone regardless of the orientation of the marker. Electronic circuitry detects the electromagnetic field within the zone at harmonic frequencies greater than the frequency of the oscillating magnetic field and, through coherent correlation, determines the presence of the marker within the surveillance zone as well as distinguishing and differentiating the marker from other ferromagnetic materials.

12 Claims, 33 Drawing Figures

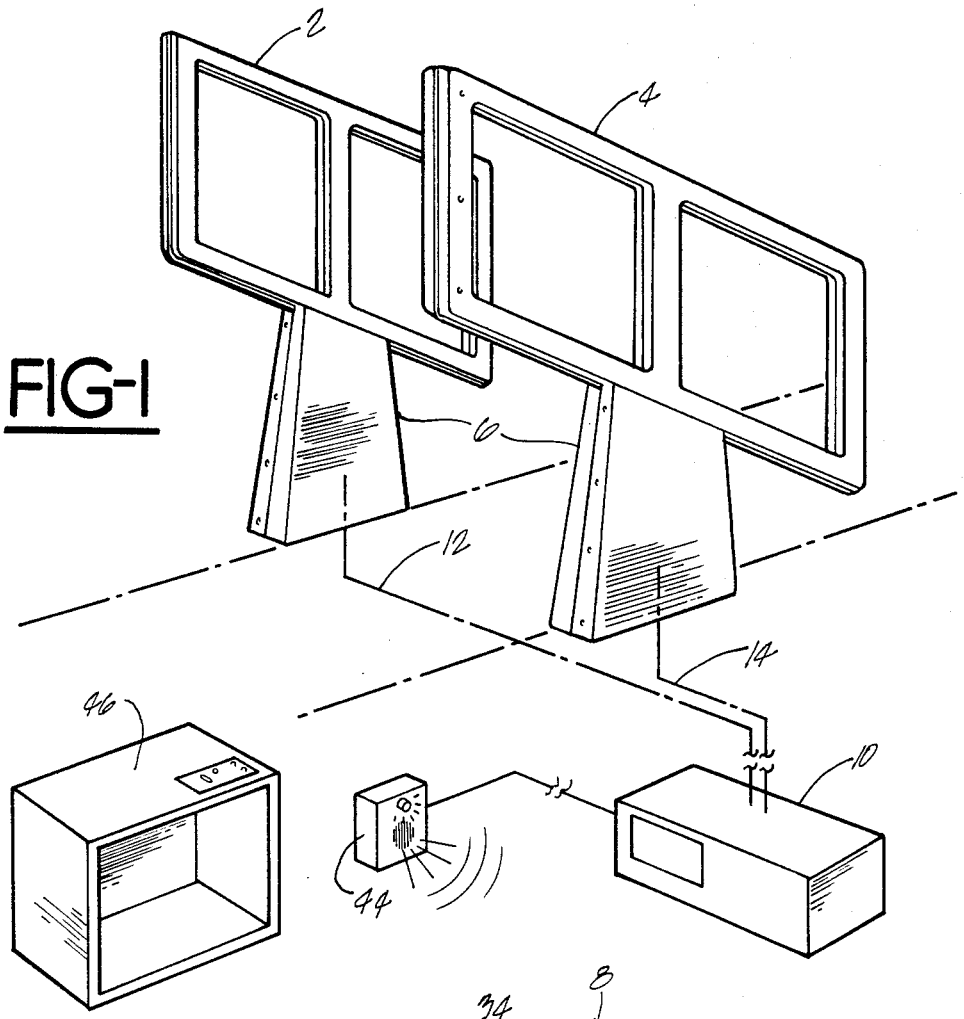
FIG-1
FIG-3
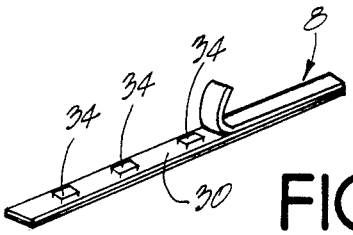
FIG-2
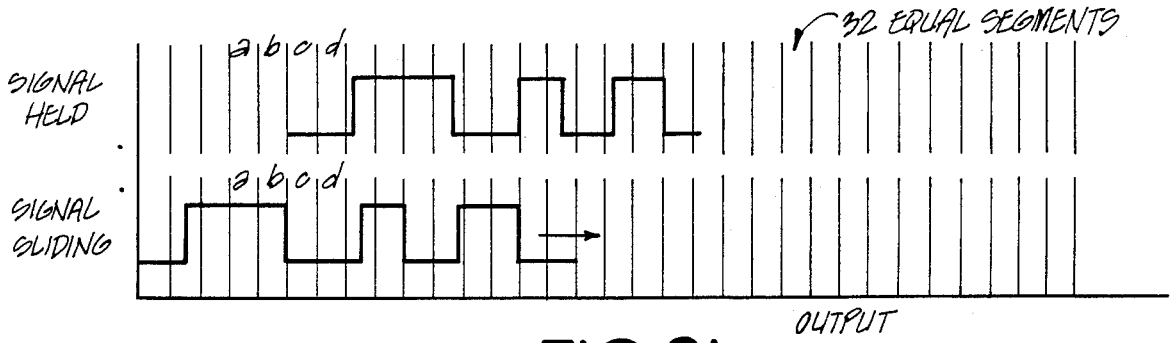
FIG-21

ANTITHEFT SYSTEM

BACKGROUND OF THE INVENTION

I. Field of the Invention

This invention relates to a method and apparatus for surveilling articles and in particular to improvements in a method and apparatus for detecting or preventing the theft of articles and more particularly it concerns the method and apparatus capable of distinguishing labels from all other objects within an oscillating electromagnetic field and a new type of label with a recognizably different signature from all other ferromagnetic labels.

II. Description of the Prior Art

In the art of antishoplifting machinery and labeling, the most successful developments have been those which correspond with labels carrying a code capable of being electromagnetically altered to designate the labeled article as being sold or checked out. Illustrative of this in the commercially available systems is the labeling and detecting arrangement offered to libraries by Minnesota Mining and Manufacturing Company (3M) under the trademark Tattletape. This group of devices includes a plurality of patents by Edward R. Fearon and one by Robert E. Fearson.

U.S. Pat. Nos. 3,631,442; 3,747,086; 3,754,226; 3,790,945 and 3,820,103 are illustrative of the antishoplifting machinery and labeling systems which illustrate a number of alternate proposals and shall serve as background for this particular invention.

SUMMARY OF THE PRESENT INVENTION

The principal object of this invention relates to providing an improved method and apparatus for detection of unauthorized removal of protected goods from a protected area.

Another object of this invention is to provide electrical circuitry which has inherently high coherent resolution characteristics so as to better distinguish between label signals and other unwanted signals.

A further object of this invention is to provide a method for generating an oscillating electromagnetic field in three vectors that is of sufficient magnitude to cause an observable effect on a ferromagnetic label in any vector within the surveillance zone.

Another object of this invention is to introduce to the art a more favorable material for use as the magnetically soft label material which unlike the material used in the prior art is not crystalline and has excellent mechanical properties.

Still another object of this invention is to provide a new type of label with a recognizably different signature from all other ferromagnetic labels.

FEATURES OF INVENTION

It is a feature of this invention to provide apparatus for detecting the passage of an object through a surveillance zone comprised of a transmitting coil for generating an oscillating electromagnetic interrogation field within the surveillance zone. The label is secured to an object, whereby said label, regardless of its spacial orientation, shall cut or link sufficient lines of flux at some point during its traversal through the surveillance zone to cause the label to generate a detectable and recognizable signal. This signal is detected by a receiving coil and associated electronic circuitry activates an alarm at the presence of a particular coherent signal from the label within the zone.

More particularly, the electronic circuitry is adapted to minimize distortion of the signal generated by the label. The electronic circuitry is also adapted so as to differentiate label signals from other signals such as pop cans which generate lower harmonics. Foreign objects such as tin cans or chairs emit harmonics up to and including the 50th harmonic when in a strong enough magnetic field.

More particularly, the label utilized has a maximum permeability of 150,000 as opposed to up to 1,500,000 as disclosed in the prior art.

It is a further feature of this invention to provide for a field generating system which shall generate sufficient lines of flux to switch a label in any one of three vectors.

It is a further feature of this invention to provide for a broad band passive fundamental filter and signal amplifier system receiver antenna which, while having a signal gain of ten, substantially nulls the fundamental frequency of the generated oscillating magnetic field and is DQ'd sufficiently such that it does very little or no wave shaping to the signal generated by the label.

More particularly, it is a feature of this invention to provide for electronic circuitry capable of processing the signal such that it is not distorted or wave shaped so that the signal retains its inherent characteristics.

It is a further feature of this invention to provide coherent filtering of the signals generated by the label. In the coherent filtering, a reference signal is produced from other sources within the apparatus for use as a standard for the coherent filtering process.

Yet another feature of this invention resides in providing transmitting coils capable of being driven in and out of phase with respect to one another so as to generate oscillating magnetic lines of flux having one vector in the in phase mode and two vectors in the out of phase mode. The field is adapted to cut or link a label with one or more of the vectors.

It is another important feature of this invention that the phase of the receiving coils match that of the transmitting coils so as to maximize the capture of signals generated by the label in response to the in phase and out of phase generation of oscillating magnetic field produced by the transmitting coils.

Still another important feature of this invention resides in providing for transmitting coils having a parallelogram configuration inclined 25 degrees to the horizontal and capable of generating sufficient magnetic lines of flux in at least three vectors to cause a label to generate a detectable signal.

More particularly, it is a feature of this invention to provide electronic circuitry capable of recognizing a label signal by utilizing coherent correlation detection techniques.

It is a further feature of this invention to provide for a method for detecting the presence of an object when the object is in an interrogation zone having an oscillatory electromagnetic field. More particularly a label capable of generating signals when placed in the surveillance zone is secured to the object whereby the signals from the label are detected by receiving coils. Upon detection of the label, electronic circuitry sets off an alarm.

More particularly, the method includes labels capable of generating signals of low harmonics such that when the label is excited by an oscillating electromagnetic field having a fundamental frequency of 12.5 K Hertz, the uppermost detectable signal generated by the label will be approximately the 160th harmonic or 2 M Hertz.

DISTINCTIONS WHICH PARTICULARLY DIFFERENTIATE THE PRESENT INVENTION FROM THE PRIOR ART

In the prior art, labels containing saturable magnetic elements are subjected to an extremely abrupt saturation process, and the transient produced by the abrupt saturation process is observed as an indication of the presence of the label containing easily saturable magnetic material. In the prior art, the ease of saturation is indispensably important, and the slenderness (the ratio or the square of length to cross sectional area of the saturable element) is a very important criteria. The requirements for a careful specification of slenderness, and an adequate intensity of the magnetic field to produce the abrupt change of magnetic condition of the label element, together with certain other inconvenient and clumsy attributes of the exciting magnetic field (these will be discussed further on) add up to a difficult demand for energy in the exciting magnetic field and establish a substantial probability that a label can be carried through the field in such a manner that it would not be excited. This would occur, for example, if the label was perpendicular to the direction of most efficient excitation while being carried through the zone. A consequence of these defects is that systems of the prior art sometimes fail to successfully interrogate an active label, and that removal of the chance of failure requires the presence of more than one label. In the present invention, it is not envisioned that there be any strong requirements for ideally abrupt switching or total change of the magnetic condition of a saturable element in a label. Rather, the present invention differentiates the label from other confusing sources of an overload signal by more elegant means that are deeply involved with many of the details of the properties of saturable ferromagnetic materials.

Assuming that a magnetic field acts upon a saturable ferromagnetic strip, rod, or wire, and that it acts parallel to the axis, and assuming that the magnetic field parallel to the axis may be expressed as a function of time by the quantity H max sin pt, the response of a ferromagnetic element, in terms of induction (total number of lines in the element) measured at the center of the element (halfway between the ends) on a plane perpendicular to the lengthwise extension of the magnetic element is :0=A sin pt+A′ cos pt+b sin 3 pt+B′ cos 3 pt+C sin 5 pt+C′ cos 5 pt . . . +xn sin ((2N+1)pt)+X′N ((2N+1)pt) . . . In the above noted series, it is worth mentioning that the terms include only odd multiples of the frequency of the excitation. This condition exists so long as there is no steady state magnetic field added. For the case where there is a steady state magnetic field added, the expression for the total magnetic field parallel to the axis becomes H1+Hmax sin pt. For this more general case, the series becomes complete, and not only odd multiples of the base frequency but even multiples also appear. One may, if he chooses, consider every magnetic effect acting upon the label as being wave dependent, and choose to designate that the average value over infinite time is zero. In such a case, the ambient field H1 is treated as though it were merely the amplitude term of an extremely long period oscillation. Generally speaking, the assumption just proposed is correct, for the reason that, from time to time, the magnetic field of the earth undergoes a reversal. In practice, however, the frequency corresponding with one cycle in every thousand years or one cycle in every 100,000 years, as the case may be, is so low that in the time frames of our interest, such frequencies may be thought of as being only negligibly distinct from zero.

Accordingly, in a practical sense, within the interval of time in which a person passes through an interrogation zone, the general form of magnetic field acting upon any label being carried is the one including the constant H1 in the form above set out. H1+Hmax sin pt. The amplitude factors of the various terms of the fourier series are always sensitively influenced by the value of Hmax. In fact, these coefficients respond to the value of Hmax in an extremely abrupt manner. To a first approximation, for very low intensities of Hmax, only the first odd term of the series is of any importance. As Hmax increases, the next thing that happens is that, quadratically, the coefficient of the double frequency term becomes noticable. At a further point in the increase of Hmax, the coefficient of the triple frequency term appears and increases at first as the cube of the increase of Hmax from the point of first appearance of an appreciable value of the amplitude of the third term. Fourth and fifth terms appear in due course and become important in an extremely abrupt manner.

In general, the onset of any term of the above described fourier series increases in a manner related to the power of Hmax corresponding with the numerical order of term. For example, the fifth term comes on as the fifth power of Hmax (or as the fifth power of a difference between Hmax and a constant). The extremely critical manner in which these terms all appear, plus the fact that they are absolutely negligible. (Below the limit of detection) At insufficient intensities of excitation (insufficient values of Hmax) is extremely important in understanding the distinction whereby unwanted signals caused by pieces of ordinary ferromagnetic material made of commercially produced iron and steel alloys, not having any special magnetic properties. The ordinary iron and steel alloys have responses similar to the responses of the saturable magnetic element corresponding with a label; but because of the radical quantitative difference in magnetic properties of common iron and steel materials from the special label material, the onset of the higher distortion terms of the fourier series has an immensely greater threshold in terms of Hmax. Like the distinctive elements, such materials, when excited, exhibit a qualitatively similar B-H response. The distortion terms vanish below the limit of observation when the field Hmax is below certain thresholds. It is clear that the field Hmax may be above these thresholds for the distinctive label and yet not comparably excite ordinary iron and steel products. The distinctive appearance of the terms corresponding with higher multiples of the frequency, such as the tenth to the twentieth harmonic, is a clearly recognizable property of the shade of the hysteresis loop of the magnetizable element of the label, and can be excited for these harmonics by an intensity that is unable to produce comparable excitation of other conventional ferromagnetic materials.

Provided now is a clear recognition of the wave form corresponding with the presence of the terms which identify the activity of a label element, and, by coherent filtering, recognition is made of the phenomenon of the distinctive magnetic cycle of the label element, which is quantitatively entirely different from the cycle of any other ferromagnetic material likely to be present in the labelled merchandise. The recognition of the distinctive wave is insured by the provision of a reference signal which, artificially generated, represents a precise prediction of what the shape of the response of a label element would be. In a manner characterized as coherent filtering, it is possible to compare a predicted wave form with the wave form actually obtained, and it can thereby be completely ascertained that the signal observed came from excitation of one of the label elements, and not from some interfering source.

BRIEF DESCRIPTION OF THE DRAWING

These and other objects and features will become apparent in the following description to be read in conjunction with the accompanying drawing in which:

FIG. 1 is a perspective view of the antishoplifting system illustrating coil housing units, electronic circuitry device, and alarm;

FIG. 2 is a perspective view of the label illustrating its internal magnetic materials;

FIG. 3 is a perspective view of the deactivating system;

FIG. 21 is a diagrammatical view to assist in the explanation of correlation.

DETAILED DESCRIPTION OF A PREFERRED EMBODIMENT OF THE INVENTION

General Description

Figure 1A:
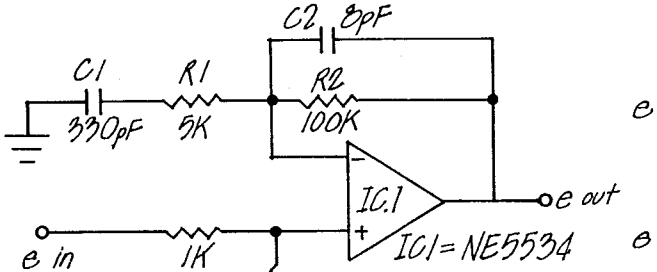
FIG. 1A is a schematic view of the coil units.
Figure 1A:
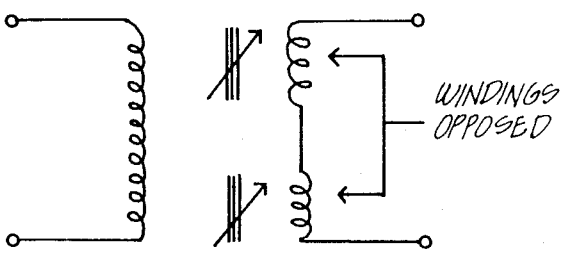

In the preferred embodiment of this invention, the improved system for detection of marked or tagged objects within a magnetic field has been adapted to comprise an improved antishoplifting device generally depicted in FIGS. 1, 2 and 3.

FIG. 1 includes two coil housing units 2 and 4 which are disposed parallel to one another and spaced apart so as to define a surveillance zone 6 intermediate said spaced coil housing units 2 and 4. The two coil housing units 2 and 4 are adapted to generate an oscillatory electromagnetic interrogation field within said surveillance zone 6 in a manner to be described herein.

A marker element, tag or label generally illustrated as number 8 in FIG. 2 is attached to each object or article (not shown) to be surveyed by the system described herein. When there has been an unauthorized passage of the label 8 through the surveillance zone 6 (as in the case of shoplifting), the label 8 will cut or link a sufficient number of generated lines of flux thereby distorting the electromagnetic field and causing a distinctive electrical loading effect on the coil housing units 2 and 4. The signal characterized by the aforementioned loading effect is communicated to an electrical detection circuit 10 by means of electrical conductors 12 and 14, which will activate the alarm 44.

When the shopper has paid for the article or object the label 8 is inserted into the deactivating device 46 illustrated in FIG. 3. The deactivating device 46 will deactivate the label 8 so that when the label 8 is passed through the surveillance zone 6 there are no distinctive loading effect signals generated by the label 8; this avoids any false alarm of shoplifting through alarm 44.

Coil Housing Units

Figure 4:
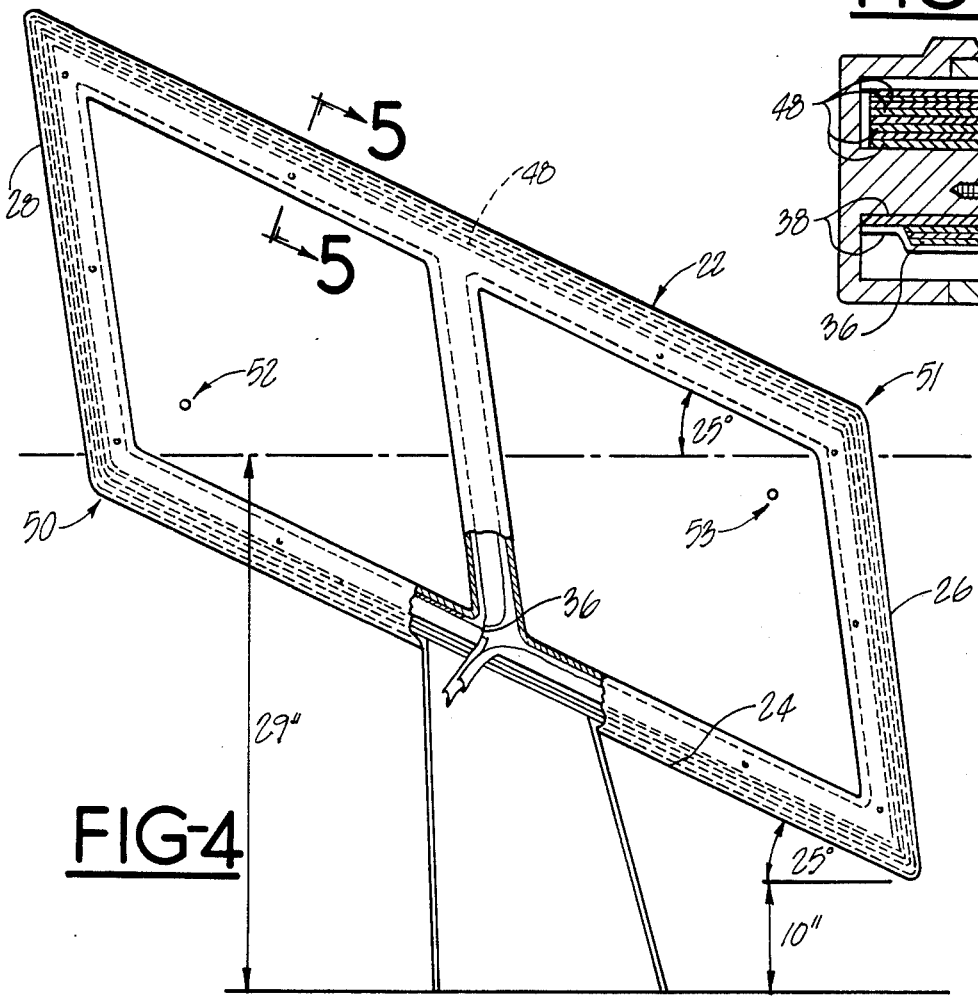
FIG. 4 is a side elevational view of one of the coil housing units which includes a partially broken view to illustrate its internal components.
Figure 5:
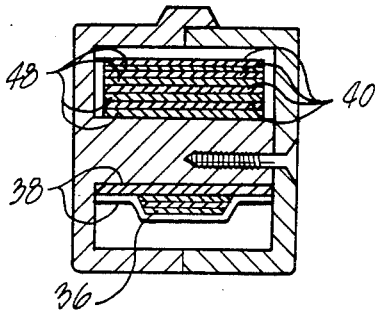
FIG. 5 is a cross-sectional view of the coil housing unit taken along the lines 5—5 in FIG. 4 revealing the transmitting coil and receiving coil.

The coil housing units 2 and 4 are each more particularly described in FIGS. 4 and 5. Each coil housing unit 2 and 4 is so constructed and driven repetitively and alternately in phase (or aiding mode) and out of phase (or opposition mode) such that a label 8 will cut or link a sufficient number of lines of magnetic flux to cause a detectable signal to be generated by said label by the two magnetic field producing coil housing units 2 and 4 some point during its traversal through the interrogation zone 6 regardless of its angle with respect to the magnetic field producing coil units 2 and 4.

Geometric Construction of Coil Housing Units

In the preferred embodiment of the coil housing units 2 and 4 respectively include a transmitting coil 48 having four turns as illustrated in FIGS. 4 and 5. Each of the turns of transmitting coil 48 are insulated from each other by insulating material 40. The transmitting coil 48 is wound in a parallelogram configuration as illustrated in FIG. 4. The slope of the two longest inclined members 22 and 24 respectively are approximately 25 degrees from the horizontal plane. The other two shorter members 26 and 28 respectively are in the vertical position. The length of the inclined members 22 and 24 and the length of the vertical members 26 and 28 are 46" and 19" respectively.

The transmitting coil 48 is disposed in such a manner that the vertical member 26 at the point of entry extends from 10" to 29" above the floor and the vertical member 28 at the point of exit extends from 29" above the floor and the vertical member 28 at the point of exit extends from 29" to 48" above the same floor. The field generated from the transmitting coil 48 so disposed will in the case of the vertical members 26 and 28 respectively have the same effect as a longer single conductor whose length is from 10" to 48" continuous and shall produce lines of flux generally in the horizontal plane.

The vertical member 28 has been designed to commence at a point 29" above the ground, which is the same height the vertical member 26 extends to, so as to avoid designing a system having a gap in the horizontal magnetic lines of flux generated by the vertical members 26 and 28 respectively accordingly the horizontal magnetic lines of flux generated by the two short vertical members 26 and 28 will have an effect similar to that of a continuous longer conductor whose length extends from 10" to 48" above the floor.

Inclined member 22 commences at a height of 29" above the floor, and terminates at a height of 48" and is 46" long; inclined member 24 commences at a height of 10" above the floor and terminates at a height of 29" above the floor and is also 46" long. The slope of both long members 22 and 24 is approximately 25 degrees from the horizontal; and the lines of flux generated by the long members 22 and 24 respectively are generally 25 degrees from the vertical. Since said lines of flux are generated 25 degrees from vertical from conductors that begin at 10" and terminate at 29" in height above the floor, an equivalent single conductor whose lines of flux were 25 degrees from the vertical would have a length of 92 inches maintaining the same slope.

Figure 6:
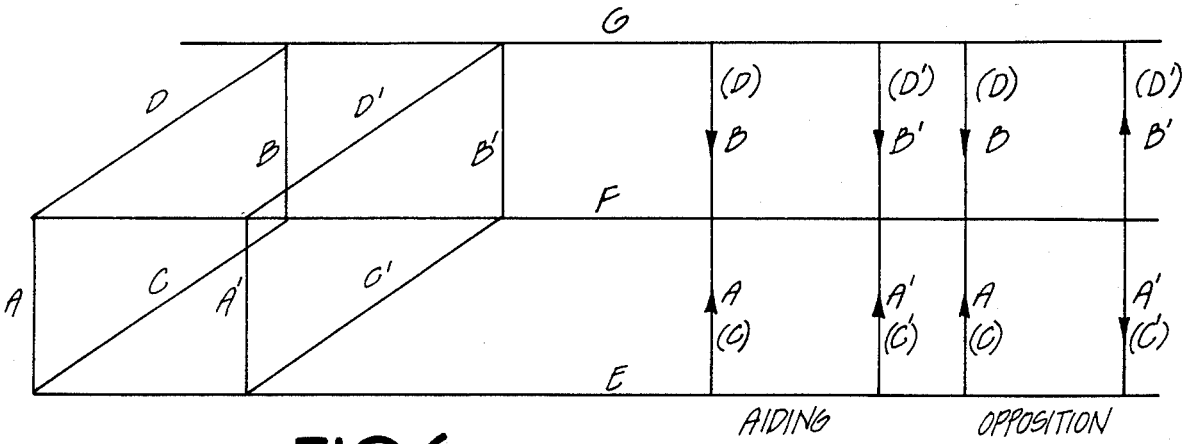
FIG. 6 is a diagram to assist in the explanation of the operation of the aiding and opposition mode.

As shown in FIG. 6, one notable exception to the similarity of the conductors A, B and C, D with respect to the above mentioned equivalent longer conductors is that the electrical current traveling in A and B and also in C and D will be in opposite directions, since the referenced members are in all cases on opposite sides of the transmitting coil 48 and the electrical current which always flows in the same direction at the same point in the time domain of a continuous conductor, will necessarily be flowing in the opposite direction due to the geometry of the transmitting coil 48 and the fact that the sides are opposite. Therefore, if the current were flowing in an upward direction in element A, it would have a downward direction in element B and likewise for elements C and D.

Driving Coils in Phase and Out of Phase

The transmitting coil 48 in each of the coil housing units 2 and 4 are driven by an alternating current source. However the alternating current source applied to one of the transmitting coils 48 in coil housing unit 2 is fixed while the alternating current applied to the other transmitting coil 48 in the coil housing unit 4 is operated so that the alternating current within transmitting coil 48 of coil housing unit 4 is in phase with the alternating current within transmitting coil 48 of coil housing unit 2 for a portion of time, and is then out of phase for a portion of time.

Figure 7A:
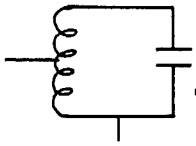
FIG. 7A is a schematic illustration of the interconnection of the transmitting coil in the constant mode.
Figure 7B:
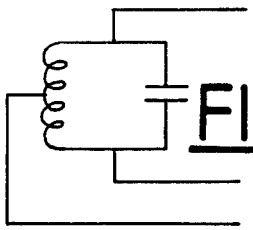
FIG. 7B is a schematic illustration of the interconnection of the transmitting coil in the alternating mode.

FIG. 7A is a schematic illustration of the transmitting coil 48 in coil housing unit 2 and FIG. 7B is a schematic illustration of the transmitting coil 48 in the coil housing unit 4.

Figure 8A:
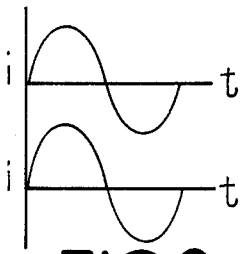
FIG. 8A is a graphic illustration of the alternating current along corresponding points of the transmitting coil when driven in phase.
Figure 8B:
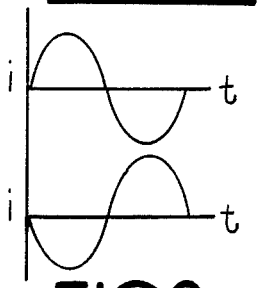
FIG. 8B is a graphic illustration of the alternating current along corresponding points of the transmitting coil when driven out of phase.

FIG. 8A is a graphic illustration of the alternating current along corresponding points of the transmitting coil 48 in coil housing units 2 and 4 when the transmitting coils 48 are operated in phase or in the aiding mode. FIG. 8B is a grahic illustration of the alternating current along corresponding points of transmitting coils 48 in coil housing units 2 and 4 when the transmitting coils 48 are driven out of phase or in the opposition mode. Consideration must now be given to the case of the generated magnetic field or lines of flux generated in the aiding and opposition modes of operation.

Vectors Produced in the Aiding and Opposition Modes of Operation

In the case of the aiding configuration, it is noted that conductors A and A1 (Which represents the portion of transmitting coil 48 in the vertical members 26 in the coil housing units 2 and 4 respectively) have electrical current travelling in the same direction, but conductors A and A1 are displaced in space by their separation distance of about 38" center to center. By applying the right-hand rule with respect to the flux generated by an electrical current travelling in a conductor, it is observed that the lines of flux at a point equidistant from the two conductors A and A1 shall have an opposite direction and shall in fact cancel if the current in the two conductors were the same.

The same discussion applies to the flux producing elements B and B1. Generally, the same applies to D and D1, and C and C1, with the exception that these flux producing elements have a slope of about 25 degrees.

In the case of the opposition configuration, it is noted that conductors A and A1 have electrical current travelling in opposite directions, but conductors A and A1 are displaced in space by their separation distance of about 38" center to center. By applying the right-hand rule with respect to the flux generated by an electrical current travelling in a conductor it is observed that the lines of flux at a point equidistant from the two conductors shall have the same direction and shall add and produce twice the flux if the current in the two conductors were the same.

This addition to produce twice the flux if the electrical current in the two conductors were the same holds true for flux producing elements B and B1, and also to C and C1, and D and D1, with the exception that the latter four flux producing elements have a slope of about 25 degrees.

It is further understood that the predominant field or lines of flux generated by the transmitting coil 48 are in a vector perpendicular to the space in which the coil exists and that the strongest field is within, or through the transmitting coil 48, since all four sides or current producing members add to one another. The magnetic field in the center of the coil 48 would be about four times as much as the fringing field as if a measurement were made at a distance equal to $\frac{1}{4}$ of the sum of the distance from the center to each edge of the conductor, from any one of the conductors on the outside of the coil 19.

Figure 9:
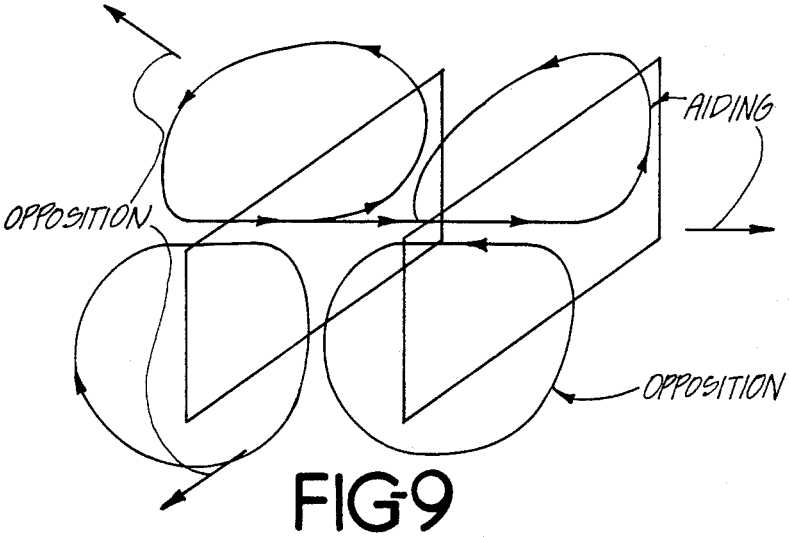
FIGS. 9 and 10 are disgrammatic views illustrating the generated magnetic field.
Figure 10:
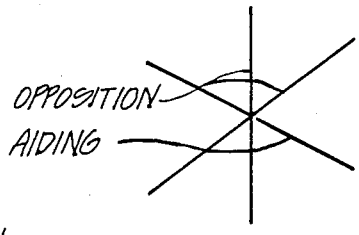
Figure 11:
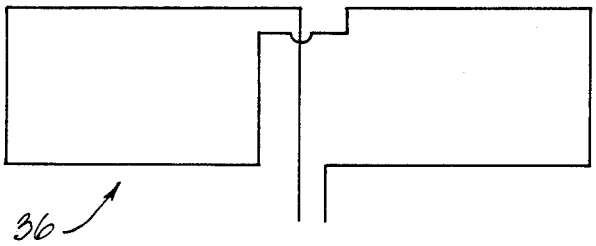
FIG. 11 is a diagrammatical view of the receiving coils mounted within the coil housing units.

FIG. 10 (a three dimensional representation corresponding to FIG. 9) illustrates that three vectors of magnetic flux are generated in the surveillance zone 6 over a height of at least 10" to 48" above the floor. Two of the vectors are perpendicular with respect to each other while the third vector (i.e. the vector extending from 2:00 o'clock to 8:00 o'clock as viewed in FIG. 10) is displaced 25 degrees from the vertical.

The aiding configuration is used primarily to produce the magnetic field which is generally at a point in the center of one of the coils perpendicular to the plane in which the coil lies and is in the same direction as the other transmitting coil 48 at the same point in time domain producing the strongest field of the three vecotrs produced, as illustrated in FIGS. 9 and 10.

The opposition configuration as illustrated in FIGS. 9 and 10 is used to generate the opposing magnetic fields that produce the other two vectors. The vector produced in the opposition configuration will be at right angles with respect to said conductors. The fringing fields add at points equidistant from the two conductors. All other points between the two conductors produce a strong magnetic field across the entire 38" spread in all vectors.

Fundamental Frequency

In the preferred embodiment, the transmitting coils 48 in coil housing units 2 and 4 are driven in phase for 13 to 15 milliseconds. During this time interval an oscillating magnetic field is generated and the vector of the generated magnetic field is perpendicular to the face of the tansmitting coils 48 as illustrated in FIGS. 9 and 10. The application of alternating current to transmitting coil 48 in coil housing unit 4 is then stopped for 8 milliseconds so as to allow switching the alternating current to drive the transmitting coil 48 in coil housing 4 in the out of phase mode as previously described. During the opposing configuration an oscillating magnetic field is generated having two vectors, one of which is perpendicular to the plane formed by the two conductors A and A1 and that the other of which is perpendicular to the plane formed by the conductors B and B1. The transmitting coils 48 in coil housing units 2 and 4 are driven in the out of phase mode for 13 to 15 milliseconds.

The cycle of generating one vector in the aiding configuration for 13 to 15 milliseconds, stopping for 8 milliseconds, and then generating the vectors in the opposing configuration for 13 to 15 milliseconds is repeated during the entire operation of the antishoplifting system.

Figure 12:
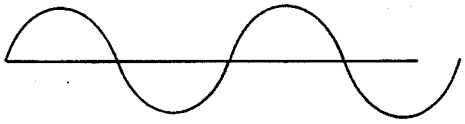
FIG. 12 is a graphic illustration of the fundamental frequency.

In this manner the transmitting coils 48 of coil housing units 2 and 4 generate a prescribed fundamental frequency suitable to resonate the coils 48 in coil housing units 2 and 4. In the preferred embodiment of the capacitance and inductance of the transmitting coils 48 in coil housing units 2 and 4 are selected so that they operate in resonance to generate an oscillating magnetic field having a fundamental frequency of 12.5 K hertz, which is graphically illustrated in FIG. 12.

Physics and Engineering Relating to the Interrogation Coil Assemblies 1 and 2 as Shown in FIG. 1

In FIG. 1A, a combination of coils and ferromagnetic materials are illustrated which depict some of the features of the assembly 1 or the assembly 2. The situation is too complicated for the FIG. 1A to pictorially fully illustrate its features, nevertheless. A fact of some importance is that the ferromagnetic material illustrated in the variable core representation in FIG. 1A is not, in fact, a complete ferromagnetic loop in any case, but always is characterized as having a large air gap. Indeed, in a practical sense, the majority of the magnetic circuit linking the coils comprises an air gap space, and a small minority is composed of the variable ferromagnetic cores. It is, nevertheless, true that the device illustrated in FIG. 1, corresponding to the diagram of the windings shown in FIG. 4, does constitute a transformer with opposing secondary windings. A further special feature of the electrical properties of the device illustrated in FIG. 4 lies in the fact that the energizing coil (turns are designated by the numeral 48), having a considerable plurality of turns, has a relatively low self-resonant frequency. In fact, the self-resonant frequency of the coil corresponding with the large number of turns (the driver or energizing coil, or the primary winding in FIG. 1A) is expected to have a value not too much higher than the 12.5 kilohertz driving frequency. It is essential that the self-resonant frequency of this energizing coil not be more than the driving frequency, or effective generation of the magnetic field would not be possible.

If, for the sake of this description, it is assumed that the self-resonant frequency of the driving coil 48 is 25 kilohertz and consider also the fact that the self-resonant frequencies of the secondary winding, having terminals 36, may be as high as 300 kilohertz, certain consequences follow. The most important consequence which follows is that the driving or energizing coil reacts to the disturbance frequencies (overload effects) in the range of 100 to 200 kilohertz as though it were a massive ring of copper. The effect of such a ring is to forbid any net change of magnetic flux linking it at the frequencies in this vicinity of 100 to 200 kilohertz. This peculiarly interesting effect of the driving coil makes it certain that, at the relatively high frequencies mentioned, any flux that pushes its way through the space included by the driving coil in one vicinity, must come back elsewhere through the open space linking the driving coil. If that were not true, there would be a net change of magnetic flux at the frequency which is forbidden to undergo such a net change. The influence of the driver coil, acting as a massive shorted turn, increases the differential effect of the two opposing coils, making the recovery of the signal (evidence of distortion and overloading) more favorable.

Figure 5A:
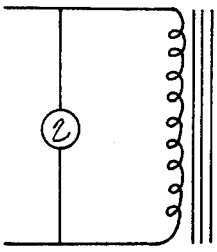
FIG. 5A is a schematic view of the coils.
Figure 5A:
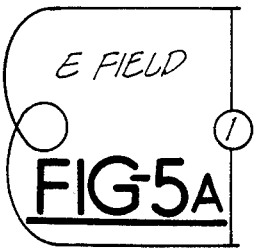

It has been mentioned elsewhere that the electrostatic shield 38, which is supplied to protect the secondary (receiver coils) from electrostatic fields due to atmospheric waves and the like, has an interruption. The nature of the interruption that is required must be understood in order to properly construct a system. The two elements indicated by the lines extending from the numerals 38 in FIG. 5 are assumed to be in metallic contact. The interruption which is requied consists of a saw cut, or some similar interference with the continuity, the saw cut required may be visualized as being perpendicular to the plane of the paper as represented in FIG. 5. Such a cut eliminates what would otherwise be a closed loop of electrical induction involving the elements of the shield, which otherwise link the coil 36 and would be coupled to it. In the FIG. 5A, we illustrate the transformer equivalent of the situation which is involved.

Magnetic Field Distribution in the Vicinity of Electrical Conductors

Magnetic fields may be considered in the light of steady state theory of magnetism whenever the frequencies involved are low enough that the wave length of the corresponding electromagnetic radiation greatly exceeds the dimensions of the region within which the field is being mapped or studied. This requirement is met with respect to the frequency of the energizing coil 48, considered in combination with the dimensions of the coil assembly as contemplated in an interrogation portal. The wave length of electromagnetic radiation corresponding with the frequency 12.5 kilohertz is 15.5 miles. The wave length of the highest harmonic that appears in the overload distortion pattern that we study is 200 times smaller, but is still 410 feet, which is enormously large compared with the dimensions of the portal, i.e. surveillence zone. Therefore, we are at liberty to think about the magnetic fields generated by the radiating coils and observed by the detection system as though they are steady state phenomena in so far as magnetic field distribution in space is concerned.

An element of length of wire carrying an electric current produces a magnetic field that falls off inversely as the square of the distance, and it further has a distribution in space governed by a legendre polynomial. In the detailed mathematical analysis of the magnetic field due to an element of length of a wire carrying an electric current. It develops that the field is always strongest in the equatorial plane perpendicular to the direction of the element of current, and diminishes for points outward from the center of the element of length but not situated on the equatorial plane, vanishing entirely on the pole extending from the element of length perpendicular to the equatorial plane. The magnetic field at any point of space in the vicinity of one of my interrogation coils may be computed by summing up the contributions due to all the elements of length of conductors which carry electric current, performing a line integral of these contributions over the entire extent of the current carriers. The mathematical analysis involved in this procedure is complex, and lies beyond the needs of the operator designing an interrogation doorway system. However, there are conclusions which can be stated which derive from the elegant theory. Among these is the fact that the oblique angles 50 and 51 shown in FIG. 4 are particularly effective in contributing magnetic field effects in their vicinity. In practice, individuals passing through the interrogation doorway will generally walk at some reasonable distance from the wall carrying any merchandise. Considering this fact, a region of space, typically identified by the point 52 and 53, is a locale of strong influence due to the magnetic effect of the oblique corner of the energizing coil 48. The lower point 53, illustrated on the entry side, is substantially above the horizontal line 29 inches from the floor. The presence of these sensitive regions at elevations differing in height makes the search of a person carrying a label corresponding with unsold merchandise more effective, involving as it does a range of heights at which he is likely to carry the merchandise containing the label. Also, it must be remembered that people differ a great deal in height and in length of arm. It is accordingly important that the range of height be adequate to cover all possibilities. To better accommodate this need for distribution of investigative height, the angle 25 degrees may be varied at the wish of the operator and designer of the equipment, and also the base elevation of 10 inches may be varied.

When the energizing coils 48 are in phase (aiding one another) a field appears quite strong in the portal in the general vicinity of the sensitivity locale 52, but extending perpendicularly across the space between the coil assemblies 1 and 2. When the phase of the 12.5 kilohertz wave is reversed so that the two portals have opposing magnetic polarity caused by the coils 48, the magnetic field perpendicularly across the space between the coils vanishes at the center of the portal, and there appears instead a magnetic field parallel to the direction in which the customer is walking. Again, the strongest part of this field is concentrated approximately at the locales illustrated diagramatically by the points 52 and 53, giving the same advantage of search at more than one height at which merchandise may be carried. The fact that the field shifts roughly 90 degrees in the vicinity of the entry and departure point when the phase of one of the energizing coils is reversed is extremely important in discovering and identifying labels on unsold merchandise. Such labels are, of course, carried by the customer at a random orientation in space. If a label is carried in such a direction that it is not interrogated when the coils 48 are aiding each other, it will be in the optimum direction when the reversal of phase occurs on one of the coils. Conversely, if a label is not interrogated when the phase of one of the coils has been reversed (the coils 48 opposing), the label will be in the ideal direction for being recognized when the phase is restored to the condition in which the coils 48 aid each other, producing a magnetic field perpendicular to the direction of the customers progress through the portal.

Loading and Overloading, Relationship of the Interrogation Portal To a Transformer The interrogation portal is comprised of a plurality of coils, some opposing and some aiding at various moments of time, and among other things in the space in which the magnetic fields from the coils extend, there is ferromagnetic material very frequently present. The ferromagnetic material, which assists in coupling the coils, or changes it as the case may be, includes shopping carts, baby buggies, jackknives, some kinds of key chains, and a large variety of other things that are, from time to time, passing through the interrogation portal. It may be said that the combination of coils and the ferromagnetic material are constantly being tested for transformer overload tendencies, and that particular attention is being devoted to the detailed analysis of the characteristics of overloads when they occur. This part of the description is added so that the operator, reading the other parts of this specification, can more easily see the reason why we have constantly used terms having to do with overload, and distortion, and so on. These terms are chosen for use herein with particular care and are beleieved to be the most accurately descriptive terms that could be used.

Description of the Interrogation Field And More Detail Concerning Transformer Related Phenomena In The Interrogation Field Each of the distinct coil units 2 and 4, taken by itself, may be thought of as a transformer with zero mutual inductance, considering the symmetry of the field, and considering quantitative aspects of the coupling to the two receiving coils. The zero mutual inductance condition of the two field generating units with their pickup coils is not destroyed by positioning them as shown in FIG. 1, nor is it destroyed by reversing the connections to the energizing coil 48 in one of the units, as for example in unit 2. However, a very big disturbance occurs when the space between the coils is unsymmetrically occupied by quantities of ferromagnetic material, either by label material or by shopping carts or by other types of ferromagnetic hardware. Conveniently, this serves for the detection and definition of such entities as may be present in the field. We present a diagram, FIG. 1A, adapted to describe the principles of the above statements. In the diagram, a primary winding, and two secondary windings which are labeled as being opposed to each other are shown. It is indicated by the diagonal arrows that the core materials are subject to variation.

Marker Element

As previously described the transmitting coils 48, in coil housing units 2 and 4, operate in resonance to generate an alternating magnetic field having a fundamental frequency of 12.5 k hertz. During this in phase operation, a magnetic field will be generated in the surveillance zone 6, whose vector is orientated as described in FIGS. 9 and 10. During the out of phase operation, a magnetic field will be generated in the surveillance zone 6, having two vectors as described in FIGS. 9 and 10.

Since an oscillating electromagnetic field is generated having three separate and distinct vector components, any label 8 which traverses through the interrogation zone 6, will be cut or link a sufficient number of lines of flux at some point during its passage through the field, regardless of the angle of orientation of the label 8.

The label 8 of the preferred embodiment consists of the use of vitrovac. The prior art discloses the use of a supermalloy marker element 8 having a maximum permeability of 800,000 and a coercive force of 0.002 oersteds. However, the label 8 used in the preferred embodiment comprises an alloy, similar to vacuumschmelze vitrovac 6025Z which has a permeability of 150,000 and a coercive force of 2.5 MA/CM.

A new basic label material is used in a preferred embodiment in this application. Amorphous materials as opposed to crystalline materials exhibit properties previously unknown in the art in that while they are magnetically soft they at the same time are mechanically hard. The elastic properties are maintained up to very high stresses and they are largely insensitive to handling (i.e. there is no permanent deterioration of the magnetic properties after mechanical stress.)

Tyical composition of a Co-FE alloy is CO 66%, FE 4% (MO, SI, B) 30% and in particular vitrovac 6025Z made by vacuumschmelze in West Germany has a 50 HZ permeability of 150,000 and a coercive force of 2.5 MA/CM.

As compared with vitrovac, supermalloy which is used in all prior art is 79% NI, 5% MO, 15% FE and 0.5% MN and has permeabilities as high as 1,500,000. Supermalloy also is magnetically degraded to a very low quality magnetically after having been subjected to even the slightest mechanical stress.

Production of amorphous metals is achieved with rapid cooling from the molten liquid state with cool rates of 10,000,000K/Sec. With the rapid cooling the molten liquid solidifies before crystallization can occur and the amorphous state is achieved.

Supermalloy as used in prior art is crystalline in form and is mechanically reduced to size by rolling and heat treating, the mechanical reduction aiding greatly in its magnetic properties. The prior art also discloses that the use of grain or domain orientated material was necessary in the use of marker elements 8. However, a label 8 having a unipolar orientation may be utilized where the anisotropy is such that the HC is the same regardless of whether the applied magnetic field is parallel to the longest dimension or the shortest one.

Unwanted Interference Signals

Interference signals which have a tendency to disguise the signal from distinctive labels result from the presence (in the electromagnetic field provided to excite the labels) of such things as shopping carts and baby buggies. These items are presented for illustration. It is to be understood that included are all articles having a general similarity to the above noted examples in the sense of containing large amounts of magnetically soft ferromagnetic material disposed in a way such that the disturbance of the electromagnetic field from the exciting coils may bear some resemblance to the disturbance caused by a distinctive label. The developments of the prior art, which have been outlined, suffer very seriously from the difficulty caused by such large magnetically soft ferromagnetic entities. In fact, the manner of operation of devices of the former art comprises recognizing the presence of such large objects, and as a reponse, inhibiting the system. Thus it is possible for a shoplifter to carry out labelled merchandise that has not been checked out, provided he does so at the same time he is pushing a shopping cart through the portal.

This system of label analysis and recognition represents a large degree of improvement over the prior art in that we are able to recognize the presence of labelled merchandise that is not checked out in spite of the concurrent presence of large magnetically soft entities such as have been illustrated by the shopping cart or baby buggy. To make the distinction between spurious ferromagnetically caused disturbances of the energizing field, and those due to authentic label material, a systematic procedure of comparison is employed extending over a wide band of frequencies. By including harmonics extending to the twentieth harmonic, more or less, it is possible to recover a great deal of detail with respect to the wave form resulting from the disturbance due to an authentic label. This wave form due to an authentic label represents a different proportion of the energy in the magnetic wave observed in regard to the ratio of the energy contained in the higher harmonics to that in the lower harmonics of the spectrum, below the tenth harmonic for example. In fact, we have discovered a quantitative procedure for recognizing the presence of a label in spite of the concurrent presence of a shopping cart or the like.

Figure 20:
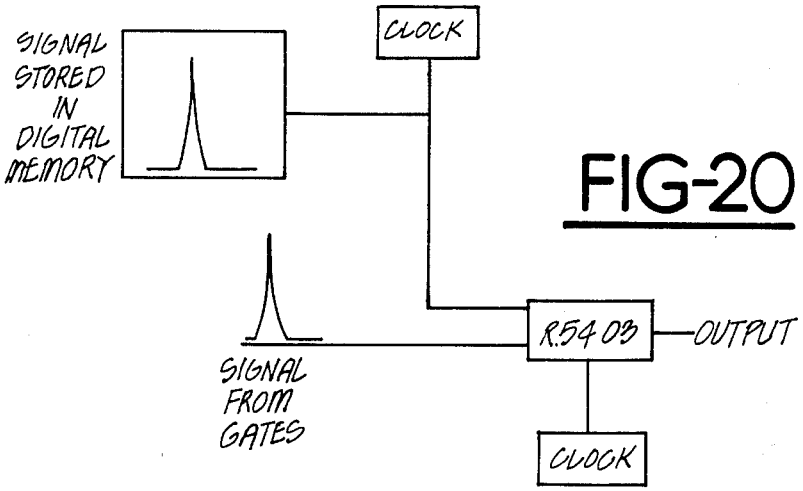
FIG. 20 is a diagrammatical view of the method of recognizing the signal by correlation.

The procedure includes, among other things, the recognition of the shopping cart, and the system observes the enormously large amount of disturbance which the shopping cart imposes in the range of the lower harmonics, from the second to the tenth. From the strength of the lower harmonic wave distortion signal, it is possible to predict what would be the corresponding amount of signal in the higher frequency range of the frequency window, from the tenth harmonic to the twentieth. The recovery of a wave distortion overload signal in the range from the tenth to the twentieth harmonic which is quantitatively larger than the signal that would be expected from a shopping cart or the like, indicates that presence of a label on merchandise that has not been checked out. One of the techniques which is used to discover the facts which have just been outlined is generally illustrated in FIG. 20 in which is diagramatically described a process of repetitively comparing the wave form of an actual signal observed in the system with reference signals which are held in the computer memory of the system. By pursuing a succession of such comparisons, we are able to clearly distinguish the presence of a label that has not been run through the check out procedure, even though concurrent presence of a large disturbance due to a shopping cart is taking place at the same time.

There are, of course, other ways of performing the same process. Among them are included the techniques of signal analysis in which, by computer techniques, we ascertain the relative amounts of such successive groups, form ratios of such energy, the ratios being a distinctive identifying feature of the observed signal. Such ratios are very different for authentic label material, as compared with shopping carts and the like. They are so different, in fact, that when we include the frequency window extending to the twentieth harmonic we are able to determine without question whether or not a label is also present, its signal superimposed on the signal of the shopping cart.

One of the distinctions of labels which is special to them lies in their behavior with respect to the earth's magnetic fields. The magnetic field of the earth in the latitudes of North America is about ⅔ oersteds. This field is, of course, indefinitely extensive when compared with the dimensions of any building or man-made structure, because the slenderness ratio of steel structural elements used in building construction is quite high, they do not effectively shield the interiors of steel and concrete buildings against the magnetic field of the earth. It is, accordingly, observed that the magnetic field of the earth exists in the spaces of interrogation passages, such as are contemplated in this system. The slenderness ratio of an authentic label is extremely high, and it is, therefore particularly sensitive to the disturbances caused by the magnetic field of the earth. Whenever a label existing on merchandise not checked out is carried at an inclination parallel to the direction of the ambient magnetic field (due to the earth) inside a building, the label disturbs the total magnetic field (due to the energizing coils and the field of the earth) in a way that is very distinctive, resulting in the production of signal waves that lack the antisymmetric quality which is often observed in such signals.

By antisymmetric quality, reference is made to the wave form which is such that the wave may be folded over at the point where the electromotive force passes through zero, the fold being perpendicular to the time axis, and folded again to reverse the sign of the voltage indicated, and produce congruence of the positive and negative portions of the wave. In the presence of an ambient field that has appreciable strength parallel to the axis of the label, the disturbance of the wave is no longer such that the congruent folding test of antisymmetry can be made. Again, this system, as diagrammatically illustrated in FIG. 20, is sensitive to this situation and can recognize it. Distinguished from a label, shopping carts and similar things have an extremely strong self-demagnetizing effect with regards to the influence of ambient magnetic field, and, for the lower frequency portion of the wave, which is a prominent feature of the shopping cart disturbance, the signal generally tends to preserve antisymmetric quality, and would substantially conform to the congruence test based on the two folding operations as described.

An Additional Distinctive Feature Of The Newly Developed Label

Figure 2B:
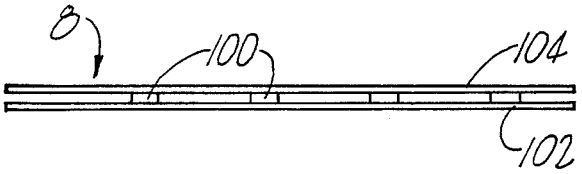
FIGS. 2A and 2B are side views of the label.
Figure 2A:
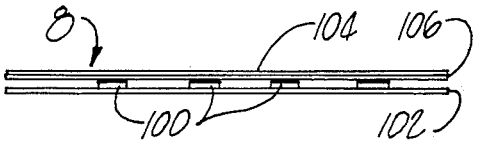

In FIGS. 2A and 2B, we have developed a particular, very peculiar additional form of label having a still higher degree of distinctness, enabling it to be better recognized as compared with former label arrangement. It will be recalled that manufacture of the ferromagnetic element of the label is contemplated as being done by a sputtering technique comprising the translation of ferromagnetic material through space by an electric discharge occurring in a partial vacuum. Conveniently, in the sputtering technique, it is possible to deliver material of controlled composition. Further, it is possible to change the composition and pass from one kind of alloy to another by switching the electrodes involved in the sputtering. It is also possible to deposit, through partial vacuum, evaporated coatings, such as for example aluminum oxide, and thus produce separation between successive layers of sputtered ferromagnetic material.

In the label design, we first sputter an alloy 102 generally resembling the material being sold by Arnold Engineering Company under the trademark "Supermalloy", having a very low coercive force somewhere in the domain of a hundredth of an oersted, then we optionally intervene a nonmetallic layer 100, after which we deposit a second layer of material 104 having a different coercive force, such as 0.05 or 0.06 oersted. We call the attention of the operator to the fact that both these coercive force values are substantially less than the maximum value of the magnetic field produced in the interrogation region when such field is measured in a favorable direction in the interrogation region. For the case of a label which is carried through the doorway, the wave form resulting from the action of the distinctive material of the label is very peculiar, much altered from that predicted for a simple ferromagnetic strip of the kind illustrated in FIG. 2. Instead of a single overload threshold illustrated by the FIG. 2 label, there are two overload thresholds, one corresponding with the lower coercive force material, and a second overload threshold corresponding with the subsequently deposited layer of ferromagnetic material of slightly higher coercive force. The greatly altered and very peculiar wave form resulting from this change, makes it especially easy to recognize the presence of a label of the kind illustrated in FIG. 2B, no wave form of any similar nature being emitted by shopping carts and the like.

In FIG. 2A, we illustrate a still further embodiment of a label with plural thresholds. In FIG. 2A, we present but one type of material. However, instead of a strip of uniform width (or uniform thickness), we supply three distinct zones (102, 104, 106) of the strip, these distinct zones having differing ferromagnetic material per unit cross section and per unit length. In the label shown in FIG. 2A, when it is carried in a favorable orientation through the interrogation region, the magnetic induction of the whole strip rises efficiently, and the entire label at first works as though it were a single uniform strip. As the induction rises, the least magnetically admissive portion of this nonuniform strip reaches a locus on its hysteresis loop at which the rate of change of induction with respect to further increases in the magnetic field becomes very small. In effect, the dynamic permeability of the least admissive segment substantially vanishes above a certain threshold of magnetic induction in it. When this threshold is passed, the other portions which contain a more liberal amount of ferromagnetic material, have not yet reached the condition to which they resist the increase of magnetic induction, being on different portions of their field-versus-induction curves, for the reason of the greater effective cross section of magnetic material. As the field continues to increase, the second least admissive portion behaves separately, imposing a second overload process, with its own threshold. Finally, the most admissive segment reacts with its own distinct overload process, showing a still higher threshold.

The concept of plural thresholds is distinct and favors the invention very strongly over developments of the prior art. The technique of extending the design to include even larger pluralities of distinct overload processes in the label is obvious and, therefore, is not described here.

Figure 13:
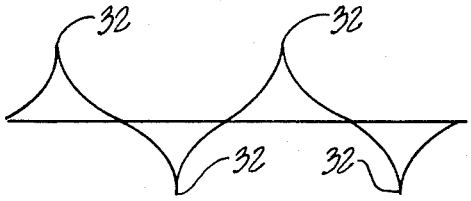
FIG. 13 is a graphic illustration of the fundamental frequency including the fundamental frequency of the signal generated by the label.

In a preferred embodiment (FIG. 2), the label 8 comprises ferromagnetic material 30, which is magnetically soft or easily magnetized. When the label 8 passes through the magnetic field oscillating at the fundamental frequency of 12.5 K hertz, the ferromagnetic material 30 becomes magnetized by the oscillating magnetic field. As the oscillating magnetic field alternates, the ferromagnetic material 30 perturbs the alternating field, inducing distortion which includes 12.5 K Hertz and higher frequencies. This distorted wave has a fundamental frequency of 12.5 K Hertz and many harmonics thereof, which combine with the fundamental frequency of the generated magnetic field, as illustrated in FIG. 13. The wave distortion by the label 8 is depicted as number 32 in FIG. 13.

The uppermost detectable signal generated by the marker element 8 in response to being excited by a fundamental frequency of 12.5 K Hertz is approximately the 160th harmonic or 2 MHZ. The prior art discloses that much higher harmonics are detectable, which is not true.

The harmonic signal 32 is received by a receiving coil 36 located within coil housing units 2 and 4. As previously stated the marker elements 8 may be deactivated in the deactivating device 46 so that no distortion effects 32 will be generated in the surveillance zone 6 during the passage therethrough. This is accomplished by including magnetically hard material 34 within the label 8 which becomes magnetized in deactivating system 46 to such an extent that the magnetically hard material 34 prevents the switching of the ferromagnetic material 30 in surveillance zone 6.

Receiving Coil

The receiving coil 36 is more particularly disclosed in FIGS. 4 and 5. The particular configuration of the receiving coil 36 is that of a figure eight. The reasoning behind the particular choice is that the receiving coil 36 acts as a passive filter element; that is, if the area of the two halves of figure eight are the same, the fundamental frequency of 12.5 K Hertz is nulled; yet, the signal 32 induced by the marker element 8 is not nulled, since the marker element 8 cannot be in both regions of the figure eight at the same time.

In the preferred embodiment, the receiving coil 36 comprises ten turns of wire located in a wire ribbon cable, the ends being so interconnected such that a ten turn coil is formed. Since the receiving coil 36 is comprised of ten turns of wire, the receiving coil 36 also acts as a passive gain stage; that is, by utilizing ten turns a voltage gain of 10 is accomplished.

Electrostatic shielding 38 is placed over the receiving coil 36 so as to shield the receiving coil 36 against receiving electrostatic signals from the ambient atmosphere. However, it is obvious that the electrostatic shielding 38 does not extend over the entire extent of the figure eight of the receiving coil 36, otherwise, the electrostatic shielding 38 would change the characteristics of the receiving coil 36.

Other receiving coils used in the trade have a tuned resonant frequency of approximately 130 K Hertz, which is where most of the energy from the signal 32 of the label marker element 8 lies.

The receiving coil 36 herein, is designed to have a much high resonant frequency than previously used in the trade. In the preferred embodiment the resonant frequency of the receiving coil 36 is 280 K Hertz. The reason why the receiving coil 36 was designed to have higher resonant frequency than the signal 32 generated by the label 8 is that a coil when excited at its resonant frequency will ring or resonate; once a receiving coil 36 rings one loses details of the otherwise distinctive loading distortion signal and obtains instead the loading characteristics of the receiving coil 36. Accordingly, the signal 32 generated by the label 8 loses its distinctiveness when the self resonant frequency is chosen at 130 KHZ.

A flat ribbon cable is used to form the receiving coil 36 since it has a lower distributed capacitance and gives a self resonant frequency of approximately 280 K Hertz.

Figure 14:
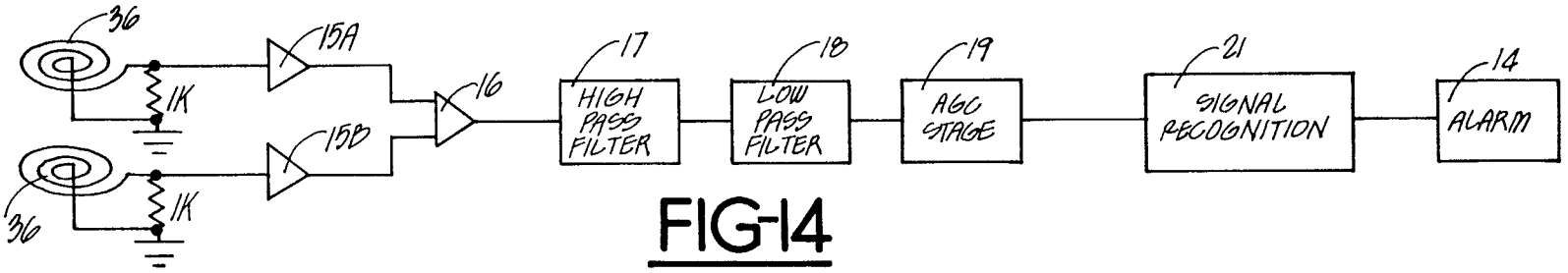
FIG. 14 is a block diagram illustrating the various components in the electronic circuitry device.

The receiving coil 36 is DQ'd (made more lossy) by the placement of a one KOHM resistor across its terminals as illustrated in FIG. 14. The 1KOHM damping resistor is added to prevent the receiving coil 36 from ringing with anything but a very large signal at its resonant frequency.

Therefore, a receiving coil 36 is disclosed which has a filter gain system with a broad band pass of about 280 K Hertz with a gain of ten that does not distort the signal at all and yet, is a passive element. Such a coil discriminates against low frequencies thus containing false effects from shopping carts, etc.

It is important that the phase angle of the impedance of the receiving coil 36 match that of the transmitting coil 48 so as to maximize the capture of load distortion signal 32 caused by the label 8 distorting the oscillating magnetic field in response to the oscillating magnetic field produced by the transmitting coils 48.

The polarization of the receiving coil 36 mounted adjacent to the transmitting coil 48 within coil housing unit 2 is wired so as to be electromagnetically aiding the effect of transmitting coil 48 in coil housing unit 2.

The phase of the receiving coil 36 mounted adjacent to the transmitting coil 48 within coil housing unit 4 is polarized so as to be electromagnetically aiding with the transmitting coil 48 in coil housing unit 4. Because of reversal (by switching) of the inputs of the transmitting coils 48 of the two units, 2 and 4, relative to each other, the receiving coils of the units exhibit a reversal of phase relative to the phase of the corresponding receiving coil of the other unit.

Electronic Circuitry

Once the signal is recovered from the receiving coil 36 without any wave shaping, the signal 32 is extracted from the load distortion signal, without substantial alteration by the electronic circuitry, is generally depicted as number 10 in FIG. 1 and more specifically itemized in FIG. 14.

FIG. 14 is a block diagram of the circuitry which extracts the generated signal 32 and which is capable of differentiating between object signals. The block diagram includes two receiving coils 36, impedance matching and gain stages 15A and 15B, summing station 6, high-pass filter system 17, low-pass filter system 18, automatic gain control stage 19, signal recognition stage 21 and alarm circuitry 14.

Impedance Matching Stage 15A and 15B

Figure 15:
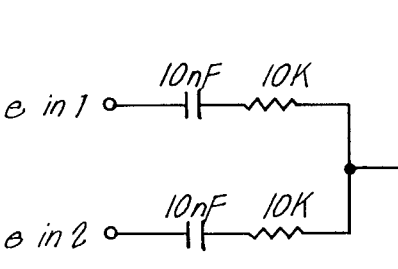
FIG. 15 is a schematic illustration of the impedance matching and gain stage.

FIG. 15 illustrates the impedance matching stage generally referred to as 15A and 15B in block diagram of FIG. 14. When wire is added to the receiving coils 36 the capacitance of the receiving coils 36 increases. Accordingly, the impedence matching stage 15A is necessary so that the coax connecting the receiving coil to the interrogator will not detune the receiving coil 36.

The impedance matching stage 15A and 15B also includes a gain stage. In practice it was discovered that by adding gain at this point, the signal to noise ratio (S/N) was greatly improved. The gain is so designed that the fundamental frequency of 12.5 K Hertz is not amplified and the lower cut-off frequency is 96 K Hertz. This stage has a gain of 20 for frequencies above 100 K Hertz and below 400 K Hertz and a gain of approximately unity at the fundamental frequency of 12.5 K Hertz. The upper cut-off frequency of 400 K Hertz was inserted to eliminate the radio frequency pickup from the receiving coil 36.

The values for the various electrical components of the impedance matching and gain stage are disclosed in FIG. 15.

The impedance matching and gain stage essentially amplifies the fundamental frequency of signal 32 twenty times while the fundamental frequency of the oscillating magnetic field is amplified by one. In this manner the fundamental frequency generated by the label 8 is emphasized so as to facilitate its analysis.

Summing Stage

Figure 16:
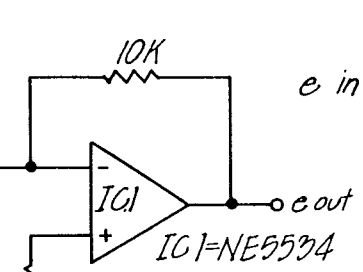
FIG. 16 is a schematic illustration of the summing stage.

FIG. 16 particularizes the summing stage generally referred to as 16 in block diagram of FIG. 14. When the signals from either gate of 15A or 15B reach the interrogator they will be summed together. Consequently, a weak signal from the center of the gates will be doubled in amplitude and then only circuitry need to handle one signal will be required.

Filtering System

The signal out is then processed through a filtering system (which will be more fully described herein) with maximum care being given to do as little wave shaping as possible. Since the electronic circuitry described herein is adapted to isolate the distortion caused by the label 8, the electronic circuitry must be designed so as not to cause or generate a distortion through our own faulty systems.

Care must be given to the filtering system utilized, otherwise problems result where due to system nonlinearities which are induced by our own system, signals could be generated which look very similar to the generated marker element signal 32.

For this reason, one preferred filtering technique is the use of a transversal filter in a band-pass configuration such as a sampled data filter which is linear in phase. These filters typically have transition rates exceeding 150 DB/Octave, and have more than 40 DB stop band rejection making them ideal for critical filtering situations.

Where less critical filtering is acceptable, the more common types of design, such as butterworth may be employed with the final result being that some additional processing may be required to give close to the accuracy of a system employing a transversal filter.

High-Pass Filter

Figure 17:
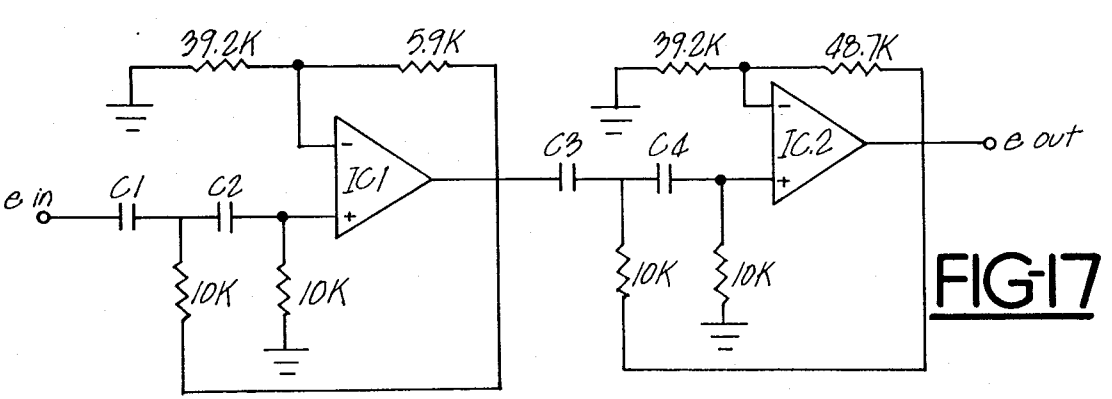
FIG. 17 is a schematic illustration of the high-pass filter.

FIG. 17 illustrates the high-pass filter utilized in the preferred embodiment. The cut-off frequency is selected to be high enough with a steep enough slope to effectively remove the fundamental frequency of 12.5 K Hertz from the signal; but leaving enough lower order harmonics to be able to discriminate signals which generate large lower order harmonics along with higher order harmonics such as pop cans and large ferrous objects.

A butterworth filter (flattest response) was utilized so that the signal is free from any wave shaping. It was determined that a 60 K Hertz lower cut-off frequency and a slope of 24 DB per octave gave the best results.

Referring to FIG. 17 C1, C2, C3 and C4 are each 260 Picofarads and the integrated circuits IC1 and IC2 are each NE 5534 ultra low noise with 15 MHZ band width. There is a component tolerance of 5%.

The high-pass filter imparts a slight gain of 2.6 or amplification of 8.3 DB to the signal.

Low-Pass Filter

Figure 18:
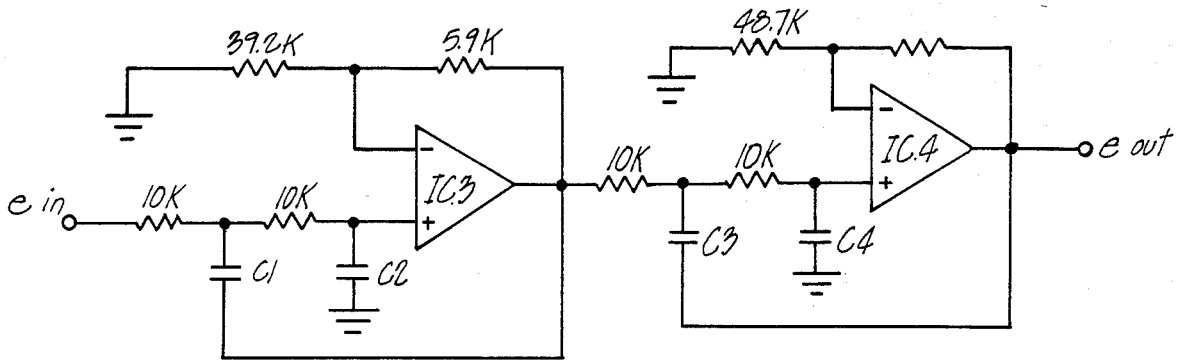
FIG. 18 is a schematic illustration of the low-pass filter.

FIG. 18 illustrates the low-pass filter of the preferred embodiment generally referred to as 18 in FIG. 14. Since a high-pass filter enhances noise, a low-pass filter with a flat response was installed to clean up the signal and get rid of any radio frequency that was picked up by the circuit.

The upper cut-off frequency of the low-pass filter was determined experimentally to operate optimumly at 500 K Hertz or more. Integrated circuits IC3 and IC4 are each NE 5534 type ultra low noise 15 MHZ band width capacitors C1, C2, C3 and C4 each have values of 39 picofarads.

The low pass filter imparts a gain of 2.6 to signal in or amplifies the signal in by 8.3 DB.

Automatic Gain Control Stage

Once the signal has been filtered, it is passed through an automatic gain control stage 19 so that the amplitude of each signal will be substantially equal before attempting signal recognition.

Figure 19:
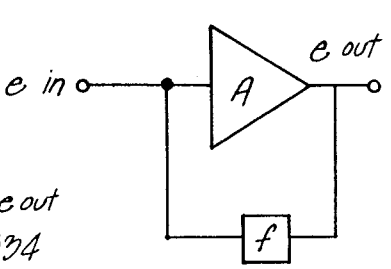
FIG. 19 is a schematic illustration of the automatic gain control stage.

FIG. 19 generally discloses the automatic gain control stage 19 illustrated in FIG. 14.

A fairly efficient automatic gain control system is required having a dynamic range of 60 DB without distortion. The automatic gain control system must be designed so as to accomodate a very weak signal in the middle of the gates (2 MV) or a strong signal almost touching the gate (500 MV). The output of the automatic gain control will be constant therefore all signals will be of equal amplitude when attempting signal recognition.

The gate input signal is first amplified then part of this signal is sent to the feedback network which will control the level of the input to maintain a constant generated output.

Figure 19A:
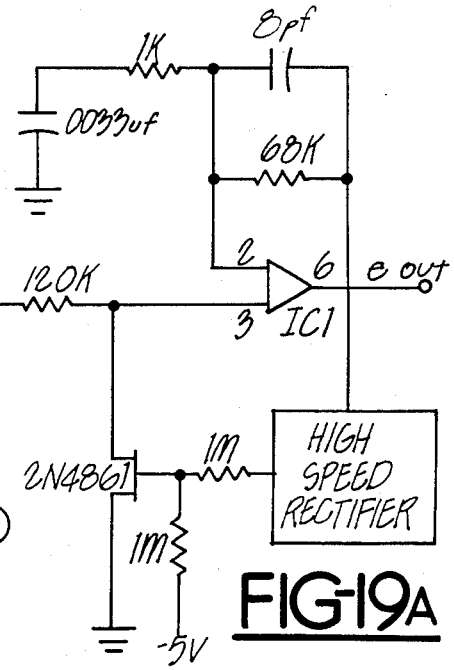
FIG. 19A is a schematic illustration of the automatic gain control stage as in the preferred embodiment.

FIG. 19A depicts the automatic gain control stage utilized in a preferred embodiment. The integrated circuit IC1 utilized in the automatic gain control stage in the preferred embodiment comprises an NE 5534 integrated circuit.

Signal Recognition

Once the signal has been retrieved and kept at a uniform amplitude, the signals can then be analyzed to determine whether it is the correct signal.

The preferred method for analyzing or recognizing the signal is coherent correlation.

Correlation

A method of recognizing the signal 32 is by the use of correlation.

Cross-correlation is a mathematical operation which indicates the degree of similarity between two signals.

The mathematical function is as follows:

$$RXY(TN) = \sum_{M=\phi}^{M-\phi} X(M)\,Y(M-TN)$$

X=First Signal
Y=Second Signal
TN=Time Broken Up Into Intervals
M=Total Number Of Divisions In particular cross-correlation means that if two signals X and Y are utilized, one signal X would be held stationary and the other signal Y would slide past the first stationary signal X. The signals X and Y would be divided up into a certain number of parts. Then at regular intervals one signal Y slides against the other signal X; this multiplies the corresponding parts together. The sums are then added. The output is maximized when two identical signals line up, giving a maximum output proportional to the degree of similarity of the signals.

FIG. 21 discloses two signal wave forms, where one signal is held stationary and the other will slide by the held signal. Each signal for example is divided up into thirty-two equal segments, the segments on the held signal are identified as A, B, C, D, etc. The segments of the sliding signal are also identified as A, B, C, D, etc.

The mathematical relation that exists is as follows:

$$(A\times A)+(B\times B)+\ldots$$

This is repeated at every segment as one signal slides relative to the other.

Correlation Circuitry

The purpose of the correlation circuit is to derive the correlation function between an input signal, and a previously stored reference signal.

Refer to the schematic diagram FIGS. 22, 22A, 22B, 22C, 22D, and 22E for the following description.

The input signal is applied to an emitter follower circuit (FIG. 22A) to buffer the line from the highly capacitive input impedance of the flash converter. The collector of the emitter follower is biased at +0.7 volts by a silicon diode. This will cause the emitter follower to saturate should the input exceed +1.2 volts. The flash A-to-D converter is rated to withstand −6.0 to +0.5 volts at the input without damage. The emitter supply voltage is −6.0 volts, therefore the emitter voltage cannot exceed the range +0.05 to −6.0 volts.

The flash A-to-D converter has a 0.0 to −1.0 volt full-scale conversion range. Because of the base emitter drop of the emitter follower, the input signal at the base of the emitter follower must have a +0.7 volts D.C. offset added to it to acheive a 0.0 to −1.0 volt range. Thus +0.7 volts input to the emitter follower yields 0.0 volts out, and −0.3 volts input yields −1.0 volts out. The −1.0 volts range is established by the A-to-D reference voltage of −1.000 volts applied to pin 5. The converter is wired in the unsigned-binary mode by grounding pin 9. The polarity of the output signals is set so that 0.0 volts into the converter equals the most positive count (1111), while −1.0 volts yields the least positive count (0000). Thus the "sense" of the signal polarity is preserved, the most negative count has the lowest value, while the most positive signal has the highest value. This "sense" can be reversed by changing the polarity of pin 7 of the A-to-D converter.

The convert command to the A-to-D converter is supplied at the 16.000 MHZ system clock rate. The four-bit binary value is latched at the end of the system clock cycle by a 74S174. This is necessary because the sum of the delay out of the converter plus the set-up time of the correlator devices exceeds the inverse of the clock time, 62.5 NSEC. The set-up time of the S174 latch is much smaller than the set-up time of the correlator. These four binary signals, labelled SIG0 through SIG3, respectively, are updated at the system clock rate. Since the output of the converter is internally latched, the delay from the input sample command to the SIG output is an extra cycle time later than the output of the converter. The D4 bit from the converter is the least significant bit, while D1 is the most significant. At the out of this latch, the significance convention is reversed for the rest of the schematic, i.e., SIG0 is the least significant bit, while SIG3 is the most significant bit.

Figure 22A:
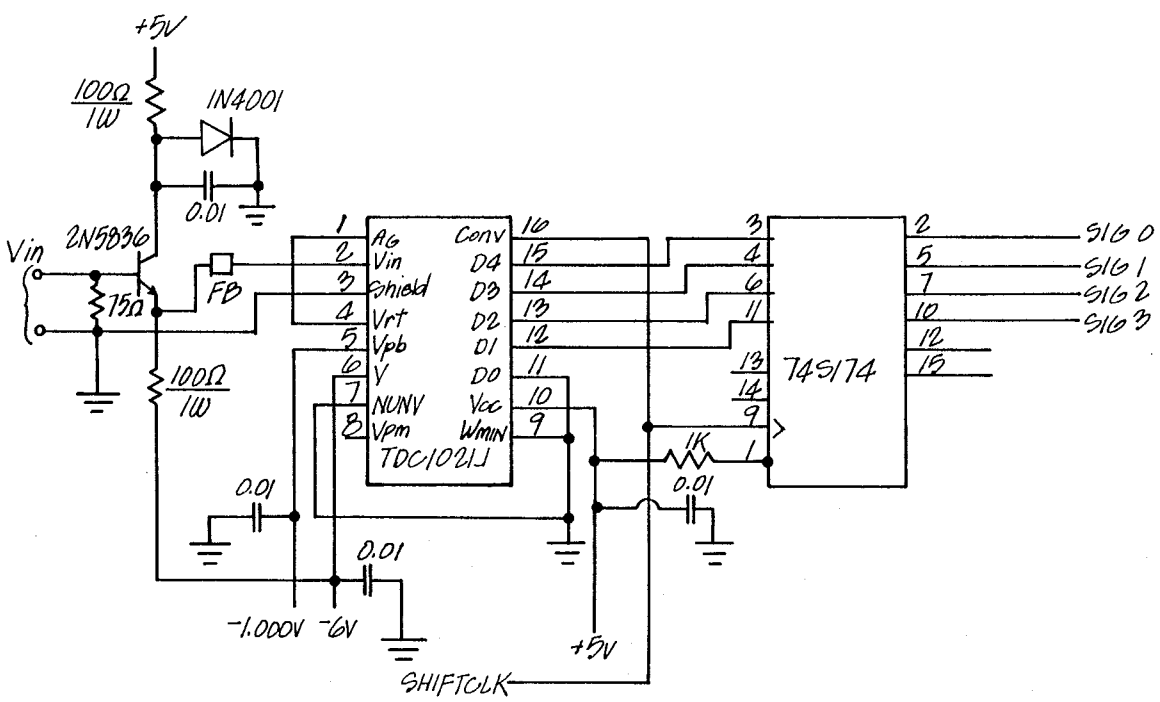
FIGS. 22 through 22E are an actual schematic representation of correlation circuitry.
Figure 22B:
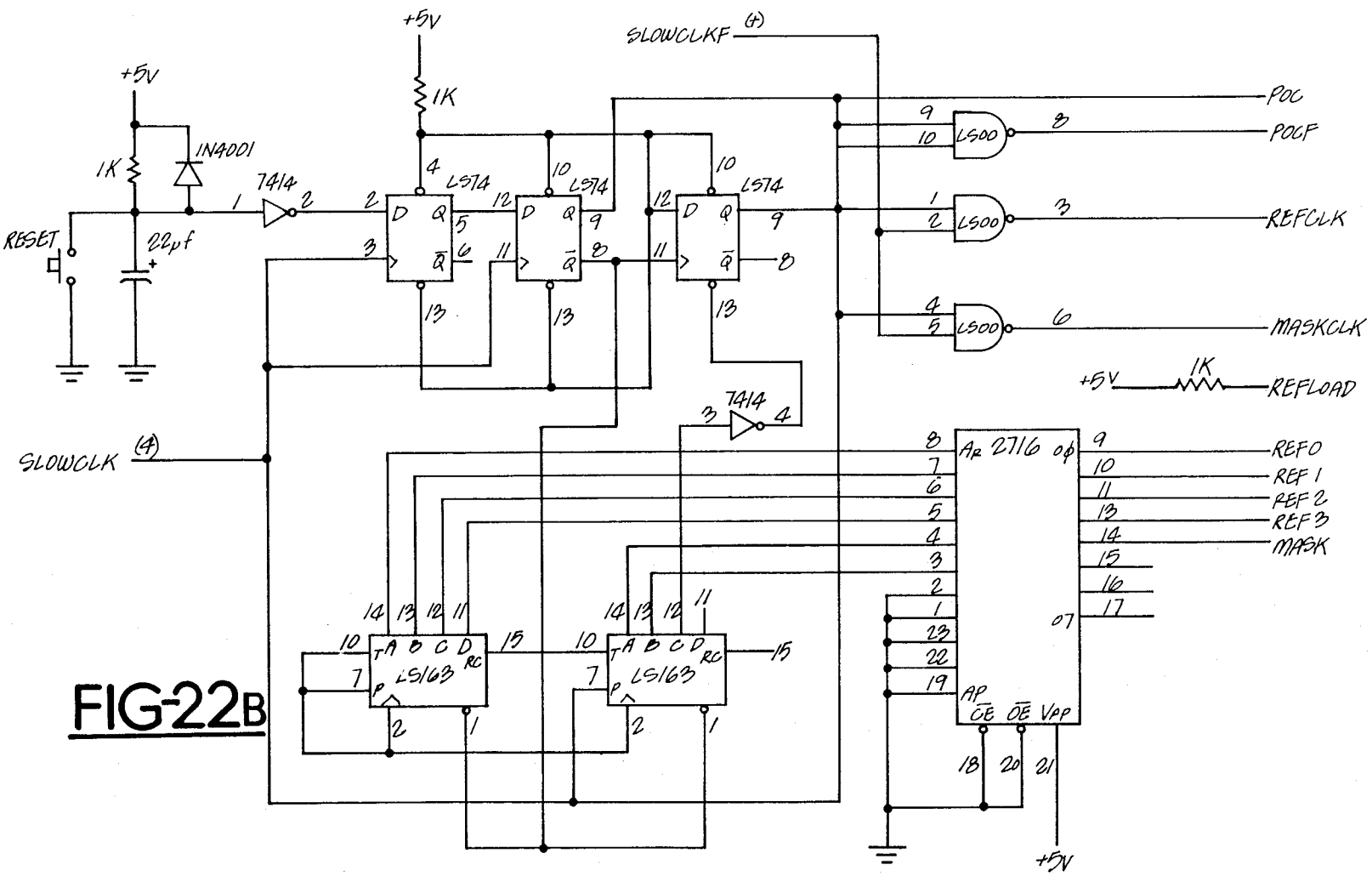
Figure 22C:
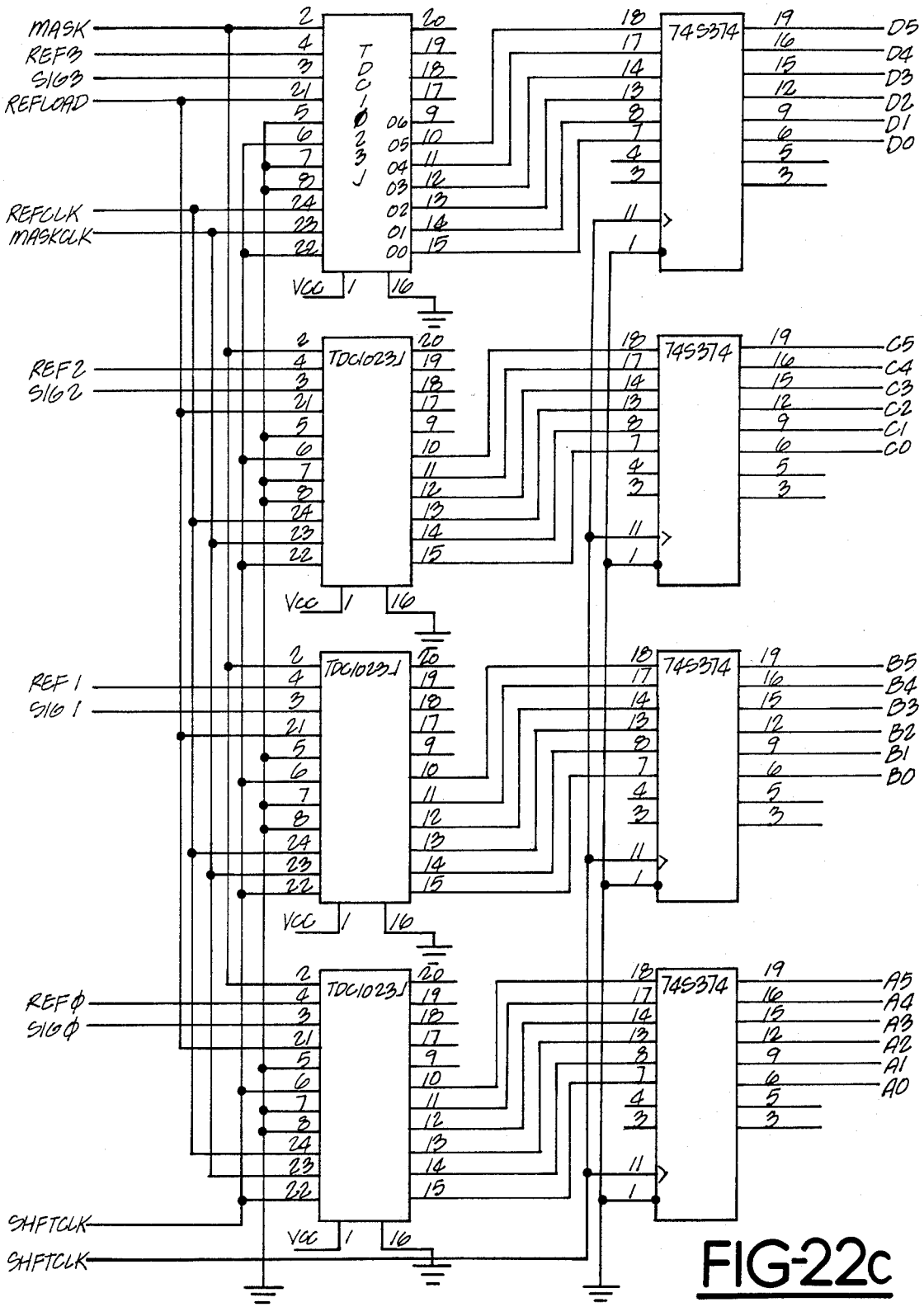

Each of these four bits, representing the analog value of the input signal, is presented to a corresponding one of four TRW TDC1023J correlator devices (FIG. 22C). Each correlator is also presented the respective reference signal, equal in binary weight to the applied bit. Thus the most significant correlator performs a correlation on the most significant input bit against the most significant reference bit. The mask signal applied to the correlators is the same because all correlators are either desired to operate simultaneously together, or to mask correlation operation simultaneously. The reference signals, as well as the mask signals are loaded with the signals mask, refload, refclk, and maskclk, which are generated by the initializer circuit, which will be discussed later. The system clock, shiftclk, is applied to the correlator devices in parallel. The correlators perform the bit-by-bit operation on the input signal with all four devices operating in a parallel fashion on a given four-bit input value.

The output of each correlator is a seven-bit unsigned binary value, between 0 and 64, describing the number of bit comparisons between the input signal and the reference signal. This seven-bit value appears three clock times after the value is input to the correlator due to the internal delays of the correlation summation circuitry. In as much as the seventh bit of the correlator is necessary only to represent the 64th state of the summation circuit, and that this application will never require the correlation internal to exceed 63 time events, the seventh bit of the correlator output is not used. This limits the maximum available count from the correlator to 63, which is represented by six bits as (111111). The six-bit output of each correlator is latched by four 74S374 octal latches. This is necessary because the sum of the delay out of the correlator plus the delay through the first summer and the set-up time of the next pipeline is exactly equal to the cycle time (62.5 NSEC). However the delay from the correlator is specified only at 25 degrees centigrade, and it is possible that at higher temperatures this delay could exceed the total time available per cycle. Thus this first pipeline (register) is used to assure that all propagation delays are satisfied over the allowed temperature range. This latching operation occurs at the end of the cycle by shiftclk.

Next, the multiplication and summation operations must occur. This is required to happen over the span of several system clock cycles because the total signal propagation delay through all of the required logic devices exceeds the system clock time. This requires the use of pipelines (registers) to hold the intermediate results. The function of the circuit is to multiply the value of the most significant correlation by eight, the next most significant correlation by four, and the next by two, and the least significant correlation by one, and then to sum the resultant values together. This implies that the value of each four-bit correlation is from zero (all bits zero) to fifteen (all bits one, derived from $8\times1+4\times1+2\times1+1\times1=15$). This is the basic principle behind the four-correlator approach.

The four correlator approach specifies that correlation at any sample time is the number of bits in agreement between the input and the reference signal, weighted according to their binary value. Thus if all four bits are in agreement, the correlation value is fifteen, and if none of the bits agree, then the correlation value is zero. The correlation of an input sample of 0 against a reference of 15 is zero since none of the bits agree. Likewise, the correlation of an input sample of 15 against a reference of 0 again yields a correlation zero since none of the bits agree. The correlation of an input signal of 4 against a reference of 4 yields a value of 15 since all of the bits agree. A true correlation value would then require a correlation of these samples against each of the four input values, requiring 16 correlator devices. This is considered impractical in this case, and the absolute agreement, rather than the numeric agreement is tested. With suitable input and reference values, and a possible coding rearrangement (a grey code which is not yet included in the circuit, depending on testing of its suitability) the resolution of the circuit is hoped to be adequate for reliable operation.

Figure 22D:
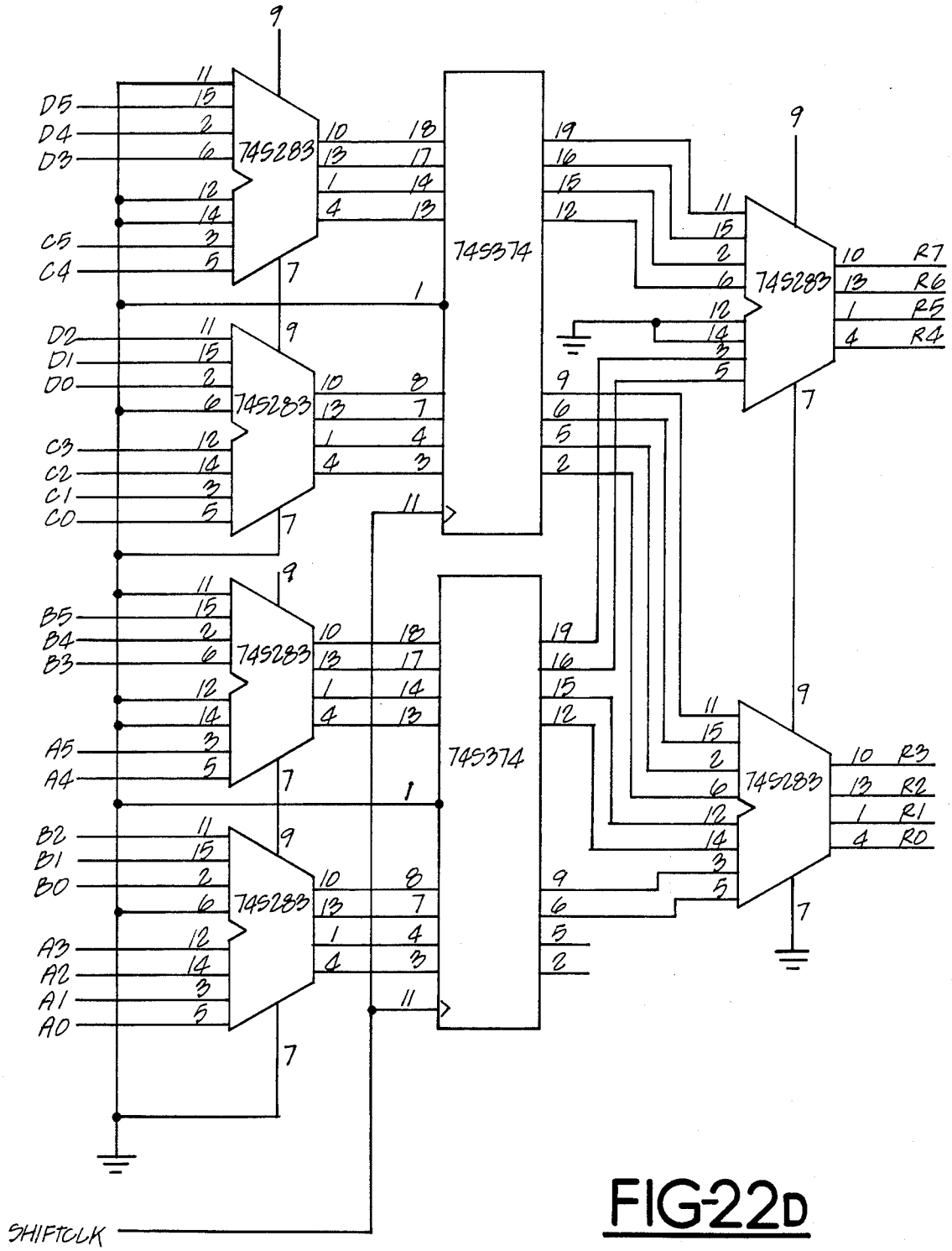
Figure 22E:
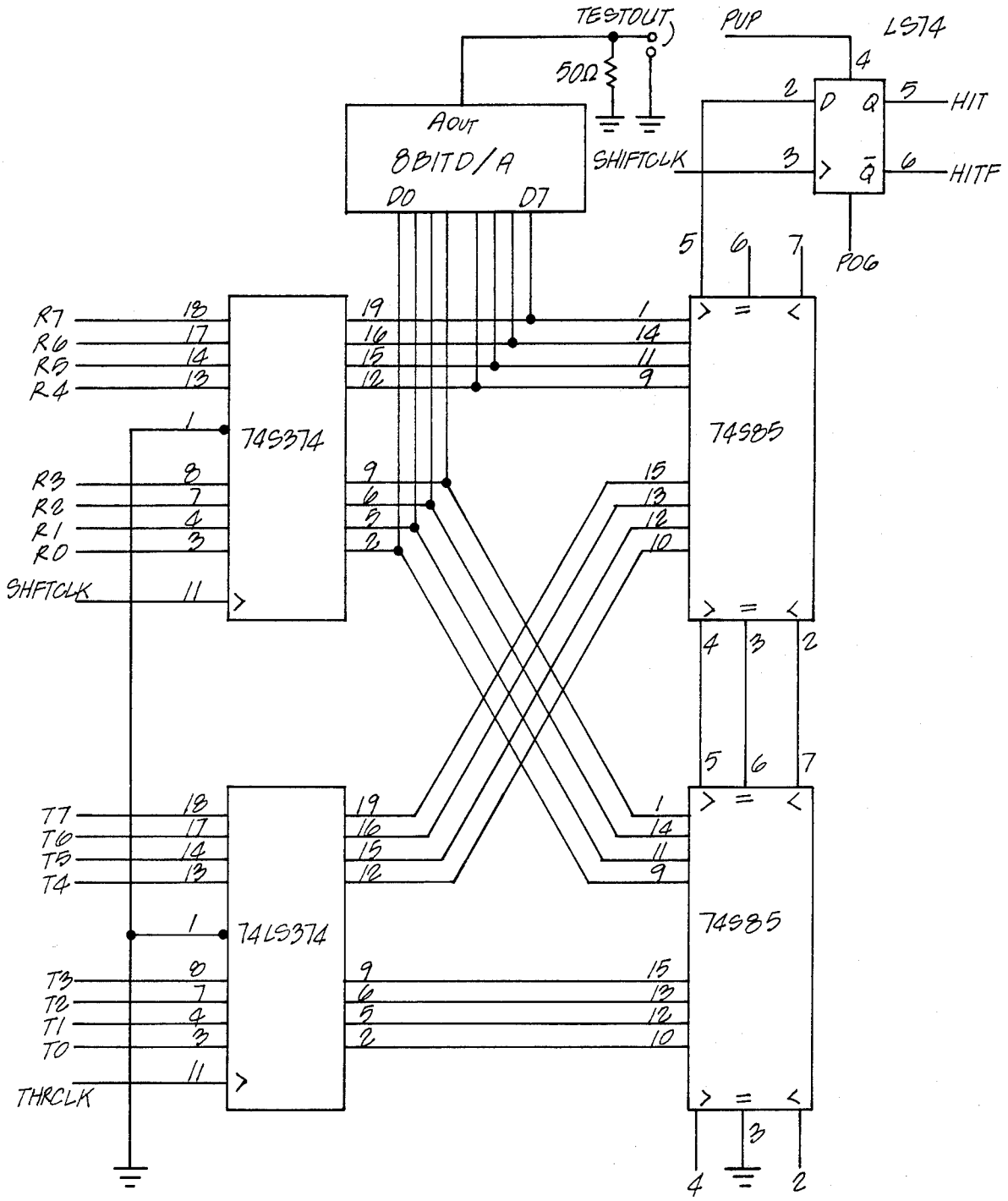

The multiplication/summation operation is performed in a sequence of operations in order to save logic (FIG. 22D). The method is as follows: the second and fourth six-bit values are multiplied by two by performing a one bit left-shift operation on the binary values. These are then summed with the first and third six-bit values, respectively. The resultant value from the $3rd+2\times4th$ value is then multiplied by four by shifting the resultant two bits to the left. This yields the proper value because $1st+2\times2DN+4\times(3rd+2\times4th)=1+2\times2nd+4\times3rd+8\times4th$. This operation occurs in two steps, the multiply by two and sum, which is then latched in two 74S374 octal latches, and then the multiply by four and sum, which is then stored in one 74S374. The resultant value would ordinarily be ten bits long, due to the bit shifts, but the two least significant bits are thrown away, because it is not deemed that this amount of resolution is necessary, and this results in a savings of logical devices.

This eight bit value, designated as R0 through R7 corresponds to the correlation value, with all the weightings taken into account. At the output of the last latch, the eight-bit value is available for use. The 8 bit D-to-A converter (FIG. 22E) is connected at this point to give an analog representation of the numerical value of the correlation score, should it be desired. Also this eight bit value is applied to an eight bit comparator formed by the cascade of two 74S85 devices. This eight-bit value may then be compared against the eight-bit value applied to the threshold latch, and designated by the signals T0 through T7. If the numeric value R is greater than T, then the output of the comparator will be true, and latched at the end of the current cycle by LS74 "D" flip-flop. This provides a cycle-by-cycle indication of the status of the correlation value compared to the threshold value.

The initialization circuitry must accomplish the task of loading all of the reference and mask values into the four correlator devices. This is started by either the power-on-clear circuit or push button activation generating a logical-low input to a 7414 Schmitt trigger (FIG. 22B). This signal is then sampled by a cascade of two "D" flip-flop elements to eliminate any bounce conditions, and to assure that perfect synchronism with the slow (1 MHZ) clock is attained. This signal generates the POC and POCF signals. In addition, this signal sets the third "D" flip-flop, and starts the two LS163 counters counting. These two counters will count up to 63 from zero, causing the eprom addresses to be incremented from zero through 63. Each of these addresses will cause the eprom data contents to be loaded into the respective correlator inputs due to the refclk and maskclk signals that are generated. Once the counter reaches count 64, the count enabling flip-flop is reset, disabling the counter, and also disabling the gated clocks to the reference and mask registers of the correlators. This burst of counting and loading activity is restarted anytime the power fails, or the push button button is engaged, assuring that the correlators should always come up initialized properly.

The clock generation circuitry (FIG. 22) generates both 16.000 MHZ and 1.000 MHZ clock signals. The 32.000 MHZ crystal is used in a colpits oscillator, which is amplified and translated in voltage level by a common-emitter amplifier. This signal is divided by two in a "D" flip-flop to assure a square 16.000 MHZ signal. This signal is then buffered by four inverters to provide a uniform distribution of the clock signals, with roughly equal and small clock loading per driving device to minimize clock skewing problems. This signal is also divided by eight in a 74LS161 counter. This 2.000 MHZ output is then applied to a 74S74 "D" flip-flop in order to divide it by two, and to provide complementary outputs that have extremely small relative skew. These two slowclk (1.000 MHZ) signals are then buffered to provide accurate clock edges to eliminate clock skewing problems.

The circuit is built on a two-sided circuit board utilizing wire-wrap construction, which is suitable for shottky logic. The planes are used for power (+5 volts) and ground (0.0 volt) distribution. Bypass capacitance for the +5.0 volts plane is distributed uniformly along the planes to assure that the inductance between any storage capacitance and the shottky logic device switching states is absolutely minimal. This is necessary because the DI/DT of shottky drivers is the highest of any logic family, and the circuit in use is fully synchronous, which assures that all the shottky devices switch at the same instant in time. Thus without minimal inductance power distribution, the multiplied DI/DT effect would temporarily reduce the supply voltage to below that required for correct operation.

Correlation is the best solution for signal recognition as it is possible to alter the signal 32 from the label 8 from one label 8 to the next at the manufacturing level and thus differentiate between the different signals 32 from the different label 8. Both signals could be stored to set off the alarm.

Correlation may also be accomplished by utilizing a pair of charge-transfer devices each for example with thirty-two taps equally spaced one sample time apart along the device, along with a pair of thirty-two bit binary shift registers for providing binary weighting of the analog taps and thereby providing correlation.

In the preferred embodiment of the invention, the coils generate an oscillating magnetic field with the surveillance zone at a first frequency $f_1$ which is preferably 12.5 K $H_z$. The marker 8 is constructed of a material which is excited by an oscillating magnetic field at frequency $f_1$ and thus generates a wide range of harmonics.

The system includes means for determining the electromagnetic field in the surveillance zone between frequencies $f_2$ and $f_3$ and for projecting the magnetic field between frequencies $f_4$ and $f_5$ wherein $f_1<F_2<f_3<f_4<f_5$. The system then determines the electromagnetic field in the surveillance zone between frequencies $f_4$ and $f_5$ and provides an output signal to the alarm when the detected output between frequencies $f_4$ and $f_5$ exceeds the projected output between frequencies $f_4$ and $f_5$. In this fashion the system is able to differentiate between the presence of a label 8 in the surveillance zone and the presence of other common metal objects such as tin cans, shopping carts and the like.

Preferably, a band pass filter attentuates frequencies less than the eighth harmonic of $f_1$ and greater than the 32nd harmonic of $f_1$. In addition the harmonics above the tenth harmonic of $f_1$ are preferably amplified.

Additional Signal Processing

When working with weaker signals caused by either spreading the transmitting coils 48 further apart in order to afford a wider passageway and a larger surveillance zone 6, or by reducing the label 8 length to extend its utility and reduce its costs, another method of signal recognition is the use of signal averaging. In a preferred form, signal averaging consists of two charge-transfer devices, each with thirty-two taps equally spaced one sample time apart, but with the taps individually connected to a set of capacitors by a means of a transfer gate. Each set of capacitors also has a reset switch to delete the previously stored information before accepting signals from a new signal iteration cycle, thus allowing flexibility in selecting any number of signals to be averaged with a signal processing algorithm based on the first order differential equation of each of the individual storage sights or taps. The algorithm is effectively the same as that of a single pole recursive filter; however, it is not subject to the degradation of the signal to noise ratio inherent in recursive integration passed by the process recycling a "coherent noise".

Whereas, the present invention has been described with respect to specific embodiments thereof, it will be understood that various changes and modifications will be suggested to one skilled in the art, and it is intended to encompass such changes and modifications as fall within the scope of the appended claims.

With reference to FIGS. 2A and 2B a plurality of high Hc segments 100 are mounted on a mechanical support 102 at spaced intervals. Either one strip 104 (FIG. 2B) or two strips 104 and 106 (FIG. 2A) of low Hc material are attached across the other side of the segments 100. The strips 104 and 106 have distinct magnetic qualities.

I claim:

1. An antitheft system comprising:

a magnetic marker, means for generating an oscillating electromagnetic field within a surveillance zone so that said marker, when positioned within said zone, cuts or links lines of magnetic flux regardless of the orientation of said marker, means for receiving an electromagnetic signal from said surveillance zone and for generating an output signal representative thereof, means for processing said output signal to determine the presence of said marker within said surveillance zone, means responsive to said processing means for indicating the presence of the marker within the surveillance zone wherein said generating means generates an oscillating field within the surveillance zone at a substantially constant frequency $f_1$, said marker being constructed of a material which is exerted by an oscillating electromagnetic field having a frequency of $f_1$ and which generates a wide range of harmonics, and wherein said processing means comprises:

first means for determining the electromagnetic field in the surveillance zone between frequencies $f_2$ and $f_3$, means responsive to said determining means for projecting the electromagnetic field between frequencies $f_4$ and $f_5$;

second means for determining the electromagnetic field in the surveillance zone between frequencies $f_4$ and $f_5$; and means providing an output signal to said indicating means when the output from said second determining means exceeds the output from the projecting means;

where $f_1<f_2<f_3<f_4<f_5$.

2. The invention as defined in claim 1 wherein said generating means comprises a pair of spaced transmitting coils defining said surveillance zone therebetween.

3. The invention as defined in claim 2 wherein said generating means further comprises an alternating current source electrically connected to one transmitting coil and means for cyclically electrically activating the other transmitting coil in phase and out of phase with respect to said one transmitting coil.

4. The invention as defined in claim 2 wherein said generating means further comprises means for electrically activating said transmitting coils to cyclically produce a magnetic field within said surveillance zone in at least three separate vector directions.

5. The invention as defined in claim 4 wherein one of said vector directions is substantially perpendicular to the other vector directions.

6. The invention as defined in claim 2 wherein each transmitting coil is substantially a parallelogram in shape, said transmitting coils being arranged in substantially parallel but spaced apart planes.

7. The invention as defined in claim 1 wherein said processing means further comprises a bandpass filter which attenuates the lower harmonics of frequency $f_1$.

8. The invention as defined in claim 7 wherein said bandpass filter attenuates frequencies less than the eighth harmonic and more than the 32nd harmonic of frequency $f_1$.

9. The invention as defined in claim 8 wherein said processing means further comprises means for amplifying frequencies above the tenth harmonic of frequency $f_1$.

10. The invention as defined in claim 1 wherein said processing means further comprises means for amplifying the higher harmonics of frequency $f_1$.

11. The invention as defined in claim 1 wherein said processing means comprises means for processing said output from said receiving means by coherent correlation.

12. A marker element for use in an oscillating magnetic field comprising a magnetic material having a permeability of less than 150,000 and a coercive force of substantially 2.5 MA/CM.

* * * * *